United States Patent [19]

Conti et al.

[11] Patent Number: 4,689,971

[45] Date of Patent: Sep. 1, 1987

[54] PROCESS AND CIRCULAR KNITTING MACHINE FOR MANUFACTURING PANTYHOSE ARTICLES AND THE LIKE

[75] Inventors: Paolo Conti; Gianni Conti, both of Florence; Franco Gariboldi, Condove; Benito Manini, Florence, all of Italy

[73] Assignee: Paolo Conti and Meritex S.r.l., Italy

[21] Appl. No.: 758,540

[22] Filed: Jul. 24, 1985

[30] Foreign Application Priority Data

Aug. 1, 1984 [IT] Italy ..... 9470 A/84

[51] Int. Cl.[4] ..... D04B 9/38; D04B 9/42; D04B 15/58; D04B 1/24

[52] U.S. Cl. ..... 66/25; 66/27; 66/30; 66/104; 66/177; 66/187; 66/139

[58] Field of Search ..... 66/8, 19, 177, 20, 25, 66/104, 138, 139, 176, 54, 27, 30

[56] References Cited

U.S. PATENT DOCUMENTS

| | | | |
|---|---|---|---|
| 435,174 | 8/1890 | Gilbert | 66/104 |
| 464,118 | 12/1891 | Gränz | 66/177 |
| 554,475 | 2/1896 | Cartledge et al. | 66/104 |
| 714,998 | 12/1902 | Bellis | 66/20 |
| 853,668 | 5/1907 | Williams | 66/20 |
| 1,151,428 | 8/1915 | Williams | 66/19 |
| 1,201,511 | 10/1916 | Scott | 66/104 X |
| 1,507,147 | 9/1924 | Barth | 66/20 |
| 2,703,972 | 3/1955 | Reymes-Cole et al. | 66/187 X |
| 3,446,036 | 5/1969 | Doughty | 66/8 |
| 3,456,459 | 7/1969 | Doughty | 66/19 X |
| 3,521,466 | 7/1970 | Tannert | 66/19 |
| 3,576,115 | 4/1971 | Schmidt | 66/19 |
| 3,975,924 | 8/1976 | Furia | 66/177 X |
| 3,999,406 | 12/1976 | Boeckle et al. | 66/177 |

FOREIGN PATENT DOCUMENTS

| | | | |
|---|---|---|---|
| 2121838 | 6/1984 | United Kingdom | 66/25 |

OTHER PUBLICATIONS

*Knitting Times,* Nov. 24, 1975, pp. 35 through 43.

*Primary Examiner*—Wm. Carter Reynolds
*Attorney, Agent, or Firm*—McGlew and Tuttle

[57] ABSTRACT

Several pairs of tubular articles are formed on two circular fixed fronts of needles using threads reciprocating transfer mechanism. The articles are alternatively formed by the two fronts by using sets of needles whose number may also vary. By using adjacent sets of needles, the two tubular, leg-shaped articles of each pair are successively formed to make up a body, that is, the panties portion for a pantyhose garment.

28 Claims, 36 Drawing Figures

IX
IX
24B
24A
150
152
142
X
X
136
144

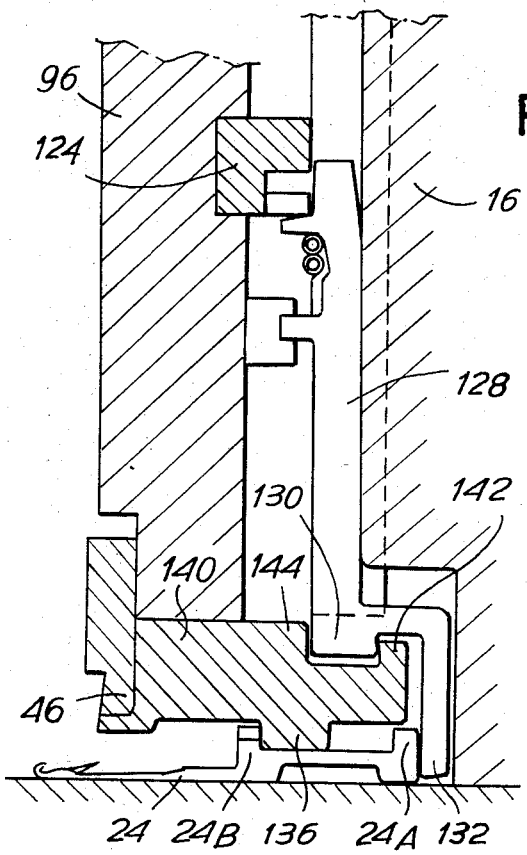
Fig. 7
Fig. 8
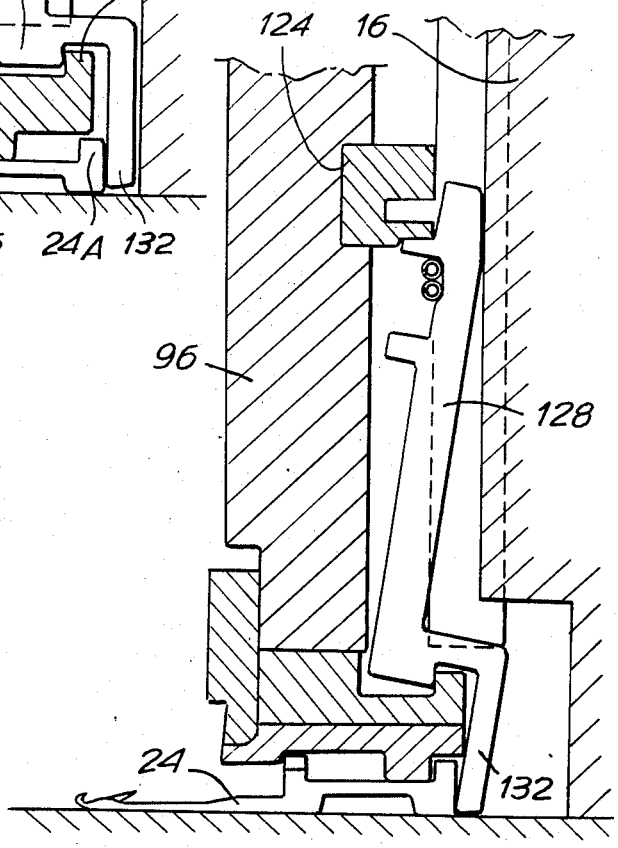

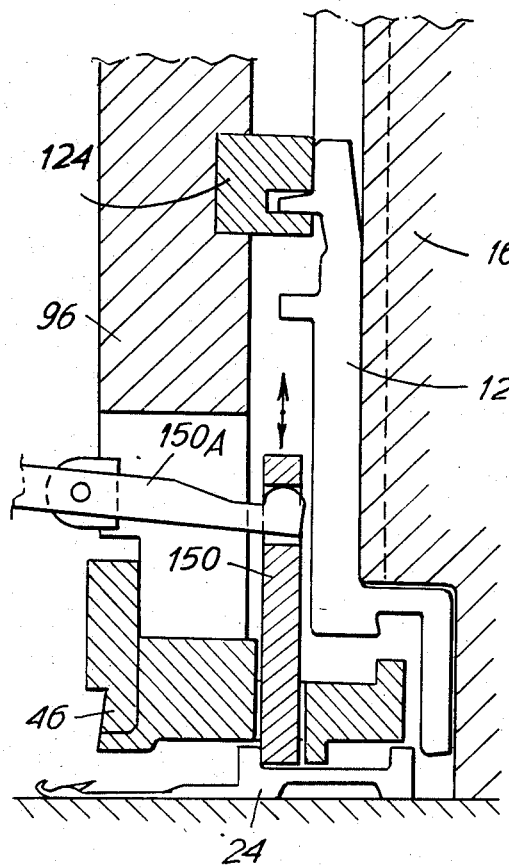
Fig. 9
Fig. 10
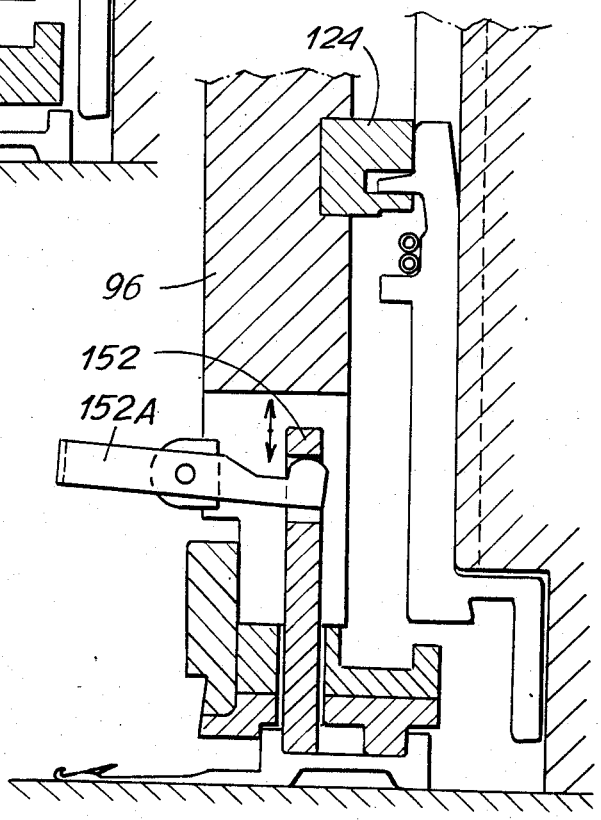

96
156
F
166
168
158A
160A
164
162
176
158
160B
160
62
170
24

180
172
96
156
F
174
178
176
182
162
24

XXI
XXII
XXII
333
331
329
335
325
307
323
321
602
600
D
319
327
303
309
301A
XXI
301
305

Fig.29
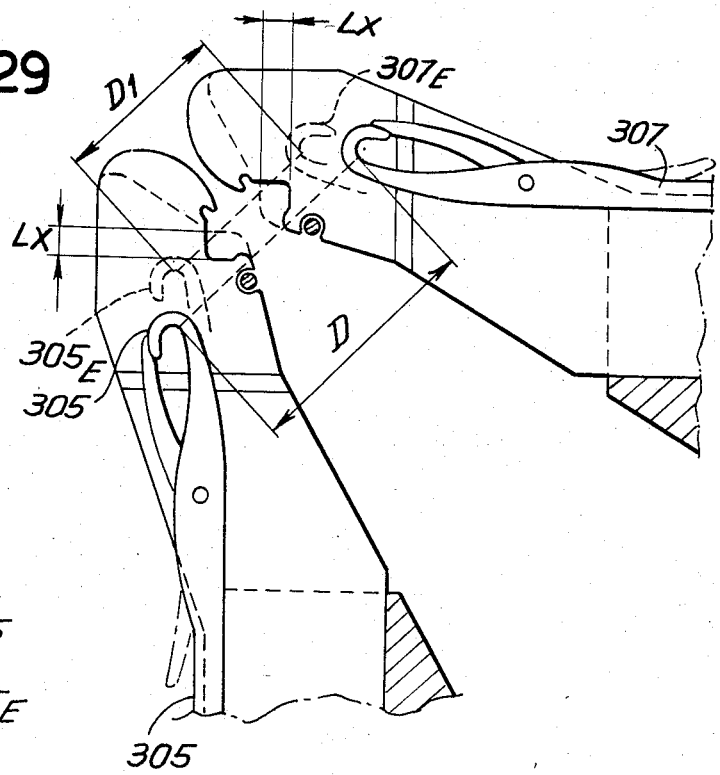
Fig. 28
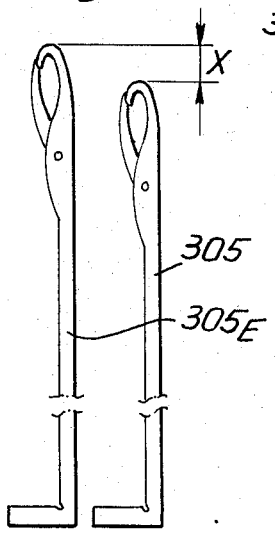
Fig.30
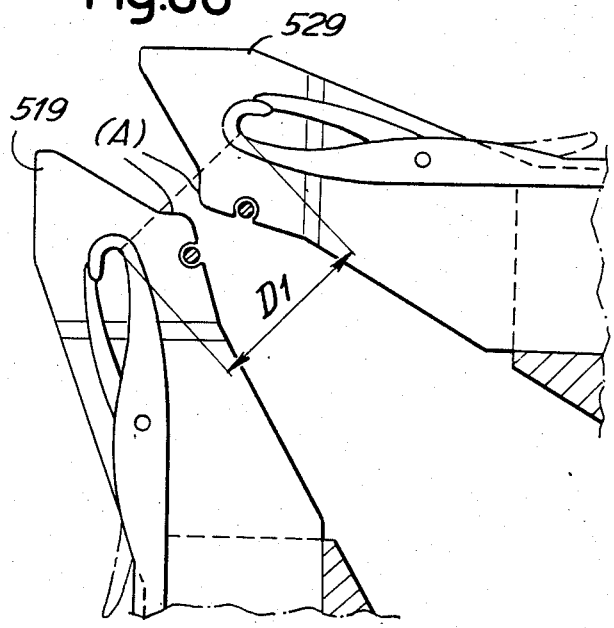
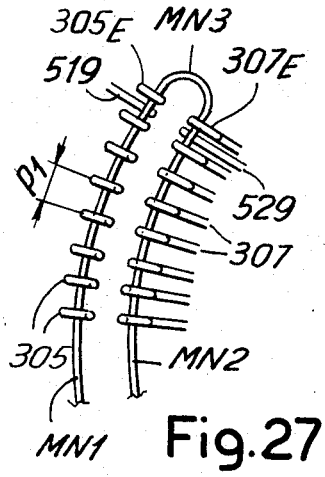
Fig.27

Fig. 33
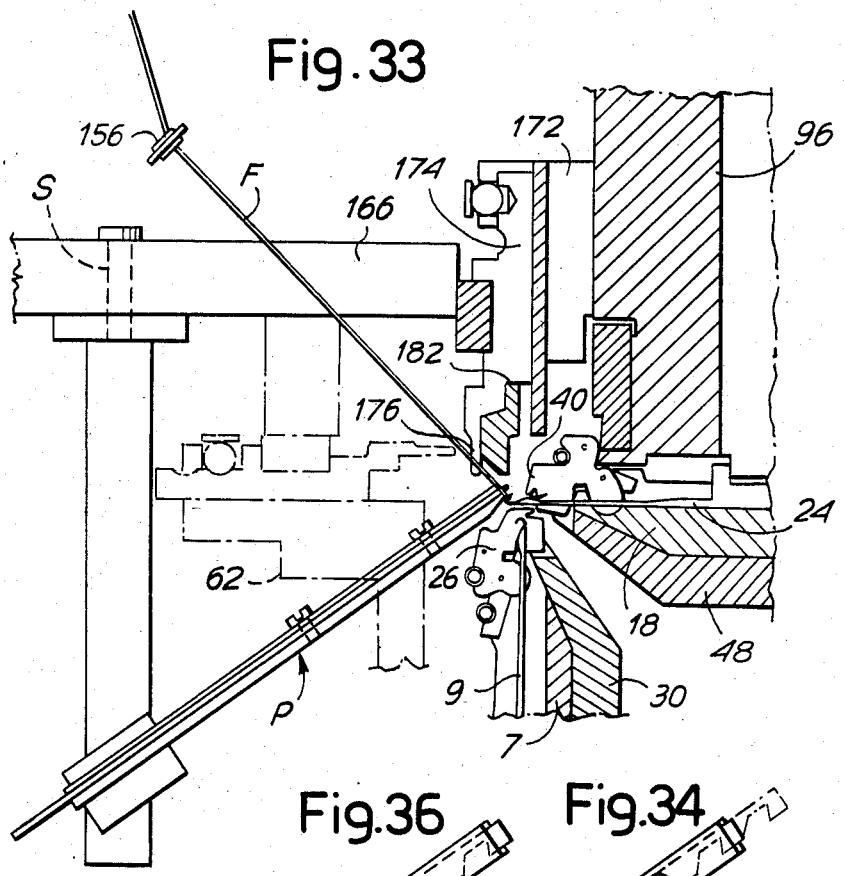
Fig. 36
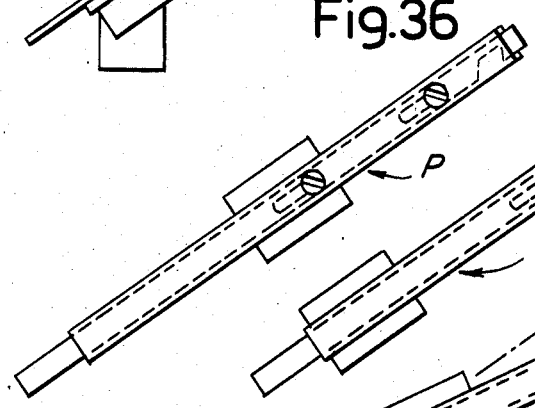
Fig. 34
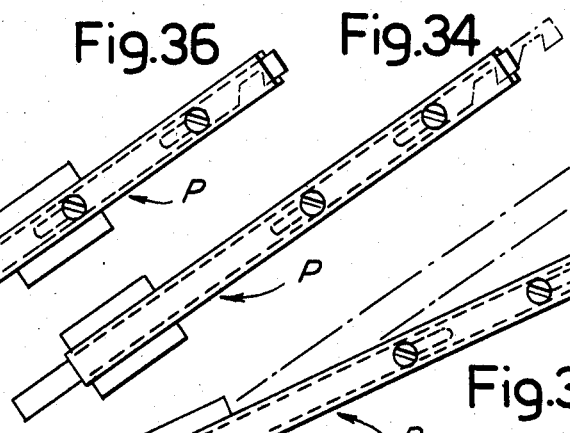
Fig. 35

PROCESS AND CIRCULAR KNITTING MACHINE FOR MANUFACTURING PANTYHOSE ARTICLES AND THE LIKE

FIELD AND BACKGROUND OF THE INVENTION

The invention relates to circular machines for stockings and the like (circular for stockings), to procedures for forming articles of stocking type and in particular for forming pantyhose, panties and similar articles, and to stocking articles realized by said procedures and machines.

SUMMARY OF THE INVENTION

One purpose of the invention is to make articles on a large-scale while avoiding, as far as possible, reciprocating motions in the machine. Another purpose is to obtain completion of the article directly on the machine even in case of pantyhose and the like. These and other purposes will be evident to those skilled in the art by the following description.

A first object of the invention is to provide a procedure for forming hosiery articles like stockings, pantyhose (collants), panties and the like. According to the invention, a plurality of tubular articles are simultaneously produced on two circular, fixed fronts of needles used with thread reciprocating transfer means. Knitted courses or rows are automatically formed by the two fronts by means of sets of needles whose number may also vary. Thus, it is possible to produce articles of stocking type. Advantageously, it is possible to produce panties and pantyhose articles as follows: sets of adjacent needles are used to form pairs of tubular articles and, successively, the two tubular, leg-like articles of each pair are joined and the work is continued to make up a tubular body, that is, a panties portion of a plurality of pantyhose articles which are produced simultaneously.

During the passage from one front to the other, shorter stitches may be formed in order to recover eventual excess thread which is likely to occur upon passage between the two fronts.

For each article, a single thread is used to form each leg and a single thread is used to form the body, if any.

Upon beginning production of the tubular leg-like articles, it is necessary to produce one or more courses of loops which are simultaneously formed by both fronts of needles, for the propose of closing the toe end of the stocking. This set of closing loops are formed on the whole width of the foot, and right after that, short rows are set up to become larger by putting at work a limited number of central needles and progressively increasing the number afterwards. In this way, the closed ends of the legs can be formed.

To beginning the formation of each body or panty portion, stitch growths from one leg to the other may be operated by simultaneously or progressively inserting the needles of the arch included between the adjacent sets of needles which are intended to form the two legs.

A second object of the invention is a machine for the simultaneous formation of a plurality of hosiery articles like stockings, pantyhose (collants), panties and the like by means of the above procedure. The machine comprises two circular coaxial fronts of needles, relatively very close together, said fronts being fixed. Two carriers cooperate with these fronts by moving with continuous motion in opposite directions to each other. One carrier carries selection and drive means for the needles of one front and the other carrier carries selection and drive means for the needles of the other front. Each carrier produces knitting action only in one direction. Yarn guide means for multiple threads—that are eventually replaceable—are provided on said two carriers so as to alternatively draw each thread along a partial frontal set of needles of a plurality of fronts assigned to the formation of the individual tubular articles in order to alternatively supply thread to the lifted needles of one front and then to the other front.

The machine may also include needle selecting means to join in time two adjacent partial frontal sectors or sets of each front which have simultaneously executed the two legs of several pairs of legs, and to realize body portions joined to the two respective tubular leg-like articles.

The yarn guide means comprise, in practice, elements driven by fixed cams in order to be brought into an active position so as to intercept and draw the thread, and into a retracted position so as to leave the thread, in correspondence of zones—eventually lacking in needles—which space out needle arches which are intended to form legs, and respectively, bodies. Said elements may be developed in the form of fingers linearly or otherwise spaced towards and out of the working zone of the needles.

Practically, one of the needle fronts is cylindrical and the other is substantially discoidal with needles lying radially. Under these conditions, the fingers can be radially moved for drawing the thread or yarn to be fed to the needles of the cylindrical front, and can be moved parallel to the axis of said fronts for drawing the feeding thread of the needles of the about discoidal front.

The two carriers of cams and transfer means for yarns are driven in synchronism and in such a way that the drive cams of the needles of the fronts and the transfer means exchange in correspondence of the front lengths which separate and space out needle arches of the two fronts which are intended to form tubular fabric, and thus in the zones between the pantyhose articles and in the crutch zones.

In order to selectively drive the needles of the substantially discoidal front, selectors (jacks) may be provided which can be connected and disconnected through selective displacement parallel to the axis of the fronts and which cooperate—when connected—with oscillation controlling contours in order to centrifugally push the needles for the thread hold. The selection means may be provided on a cylindrical fore set, while withdrawal means, and those of non-selected centrifugal needles of the discoidal front, are provided along the needles trajectory.

Advantageously, the substantially discoidal needle front and the carrier of the selection means relevant thereto are mounted on a structure which is axially movable towards and away from the other needle front.

The machine may include oscillating sinkers with discoidal, arch-shaped appendixes for oscillation and with guide spacers; said oscillating sinkers are urged by elastic means in one direction and in the opposite direction by driving profiles carried by opposite rotating carriers.

To render regular the stitches along the article zones between the ranks portions formed by the two fronts, means may be provided for controlling a stitch forming stroke in the end needles which is shorter than the one of the other needles belonging to the needle arches which are to form a length of tubular article, especially and at least along the legs.

In order to avoid flaws (or defects) in the article, the end needles of the partial fore sets are longer than the others. On each front there may be provided at each end a single longer needle or even two longer needles having also different lengths.

Advantageously, moreover, at the end zones the edge of the sinkers which defines the pulling-down plane is higher than that defined by the other sinkers.

In an improved embodiment, the sinkers of the two fronts are fixed and shaped with edges which define the pulling-down plane, with back convex profile.

At least some of the sinkers may have, adjacent to the back arched profile for supporting stitch loops, hook shapings overhanging the edge which defines the pulling-down plane. Alternatively, at least some of the sinkers may have a profile lacking hooks. There may be also provided fixed sinkers with hook shapings alternated with fixed sinkers without hook sinkers. In this case, to the fixed sinkers with hook shapings of a front, fixed sinkers without hook in the other front may correspond.

A further object of the invention is to provide pantyhose (collants), panties and stocking articles realized by the above procedures and/or machine.

A further object of the invention is to provide a procedure for realizing a shaping of a closed end—like the toe of a stocking or the like—without any manual intervention. A further object of the invention is to provide an article—like a women's stocking, a collant, a sock or other article—which has a shaped zone, particularly a shaped end.

According to the invention, the present procedure provides that adjacent to said end, zones are formed with the presence of floated or tuck stitches, thereby determining a shortening of the fabric in longitudinal direction.

Adjacent zones may be provided with an ever growing presence of floated (or tuck) stitches to increase the shaping.

Advantageously, longitudinal rows of stitches are intercalated with cleared stitches and longitudinal rows of stitches are intercalated with floated or tuck stitches. Rows of the cleared stitches are interposed into rows of floated or tuck stitches.

A zone that is shortened to a greater extent presents a minor number of rows of cleared stitches in respect to a zone that is less shortened.

In order to accomplish symmetrical shapings there are provided symmetrical zones with floated stitches.

A knitted shaped article, obtained through the above procedure, can be a stocking or respectively a pantyhose (collant) with the toss being closed by a row of stitches in common with the two fronts, which are shaped by the same procedure.

The invention will be better understood by a reading of the following description in conjunction with the accompanying drawings which show a practical, non limitative exemplification of the invention itself.

BRIEF DESCRIPTION OF THE DRAWINGS

In the drawing:

FIGS. 7 to 10 show an enlarged detail of FIG. 2 in different attitudes;

FIGS. 27, 28 and 29 show a disposition of the needles and sinkers in correspondence with the end of a tubular article formed by a cylindrical front and a discoidal front;

FIG. 30 shows a detail of FIG. 29;

FIG. 33 is a view similar to FIG. 14 illustrating the use of a trapper for trapping the thread;

FIG. 34 is a top-plan view of the trapper with its sliding plate in a retracted position, showing an extended position for the sliding plate in phantom line;

FIG. 35 is a view similar to FIG. 34 showing the trapper rotated for cutting the yarn;

FIG. 36 is a view similar to FIG. 34 showing the trapper in a position away from the yarn.

DESCRIPTION OF THE PREFERRED EMBODIMENTS

Figure 1:
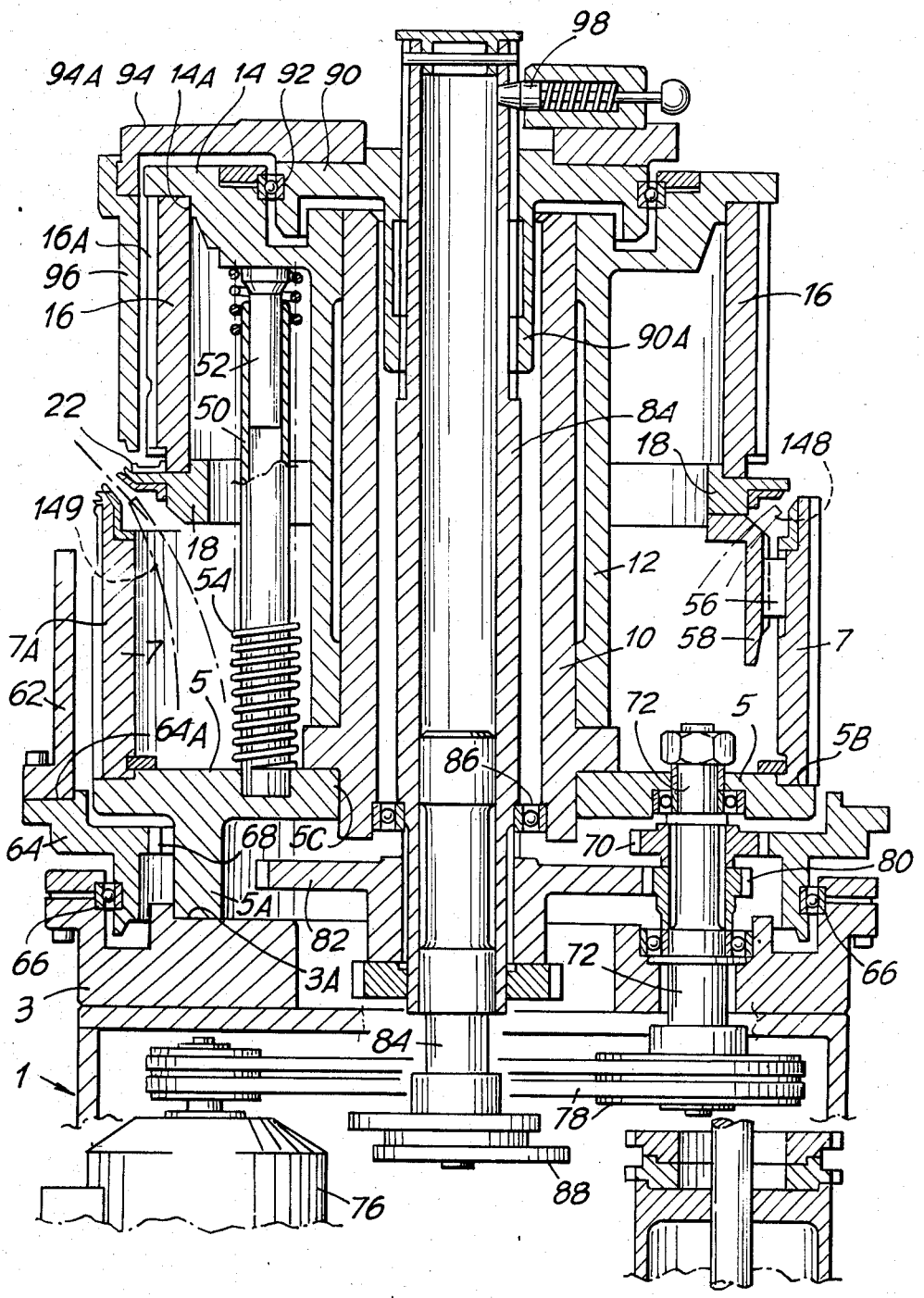
FIG. 1 shows a sectional ensemble view of the inventive machine.
Figure 2:
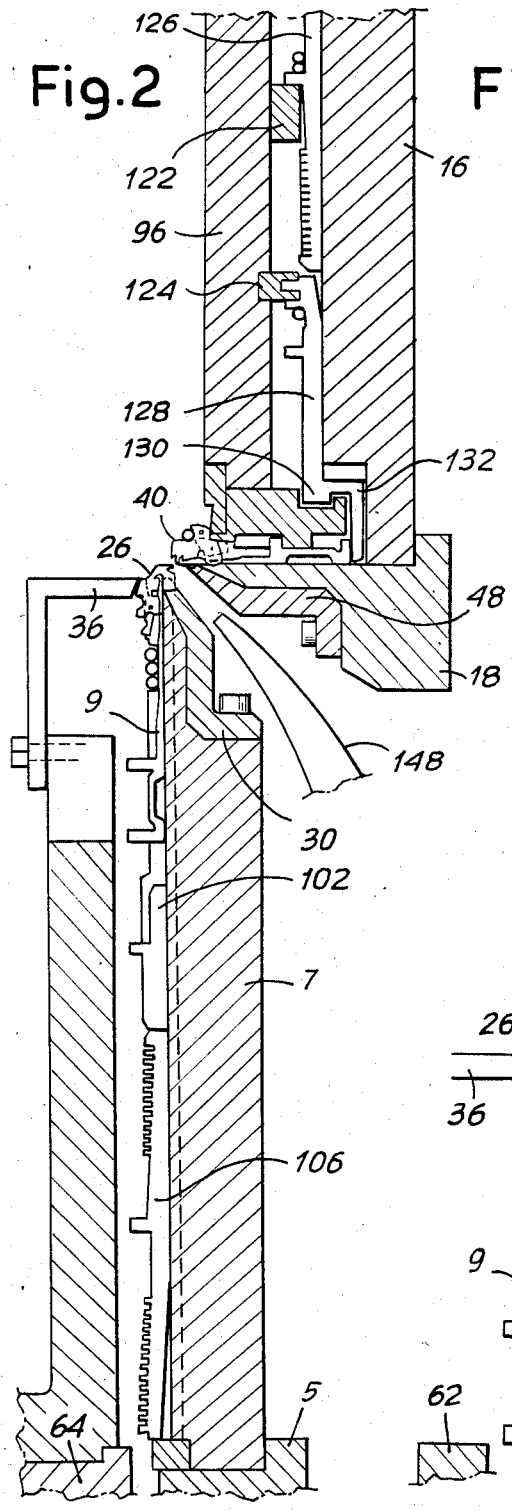
FIGS. 2 and 3 show two enlarged details of FIG. 1.
Figure 3:
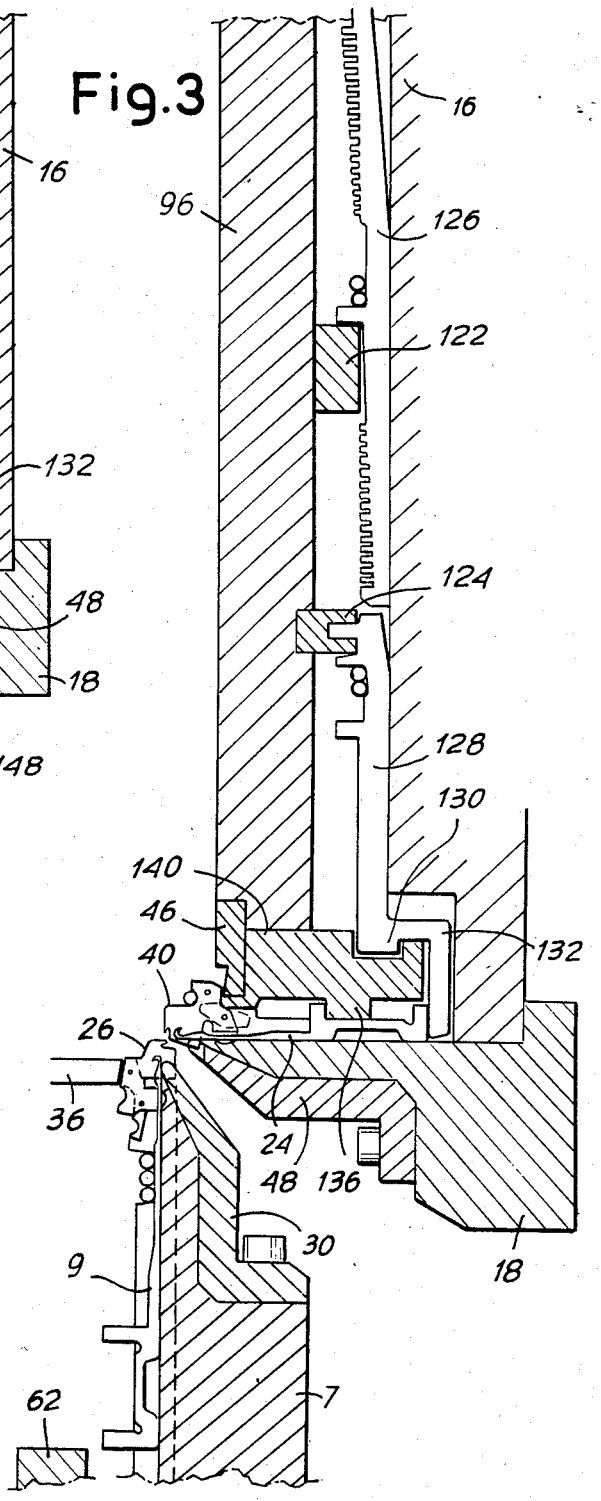

According to FIGS. 1 to 17, the number 1 indicates a base housing on which a plate support 3 is laid. This support 3 has an annular seat 3A for the lower appendix 5A of the plate 5. This plate 5 presents, in turn, a seat 5B to which a cylinder 7 is suitably fixed, forming a bed for the needles of a first, cylindrically developed front of lower needles. This cylinder 7 thus presents traditionally grooved seats 7A for the needles 9 of said first needle front. Cylinder 7 is stationary. Into a central seat 5C of plate 5 a cylindrical column 10 is inserted and is also stationary. On this column a sleeve 12 is slidably fitted. Sleeve 12 has on top a flange part 14. This part 14 forms, in turn at the bottom, an annular seat 14A for a cylinder 16, also stationary, which in turn forms slide channels 16A for a set of selectors or jacks whose function will be better explained later. At the lower end of cylinder 16 an annular element 18 is provided and fixed to the cylinder 16. The annular element 18 makes up a bed of radial channel-shaped seats 22 for the needle 24 of a second needles front, which needles 24 are, therefore, also radial and radially slidable. The two fronts 9 and 24 lie close to each other in the needle work zones where the needles 9 have at their upper end the traditional hook (or crook) with latch and where the needles 24 present the hook with latch at their outer end. The cylinder 7 is supplied with a plurality of sinkers 26 which are to cooperate with needles 9 by moving in radial planes. These sinkers 26 are shaped with appendixes 26A with circular profile, by means of which they are swingingly received—for radial displacements—into an annular channel which guides their swing. The sinkers 26 are guided by overspacers and by laminate elements 28 laterally applied thereto as well as by an inner guide reed or comb formed by the end millings of a crown element 30 fixed to the cylinder 7. An annular spring 32 urges the sinkers 26 with the appendixes 26A into the annular oscillation seat, and the annular spring 34 urges the sinkers 26 angularly in the direction of arrow f34, that is, the active upper ends of said sinkers in the centrifugal direction. Against the action of annular spring 34, the sinkers may be driven in the centripetal direction by camming profiles 36 which are movable relative to the sinkers. Further sinkers 40 are provided for the front of the radial needles 24. Also these sinkers are angularly movable owing to the slide motion of their circularly profiled appendix 40A into an annular seat provided in the annular element 18 which forms the bed for the needles 24. Sinkers 40 are also guided in their angular displacement in the radial planes wherein they lie, owing to the presence of an overspacer and of a laminate element 42 laterally applied to each of them. An annular spring 44 urges the sinkers in the direction of arrow f44, that is, the outer active ends of sinkers 40 in the lift direction. Against the action of the annular spring 44, sinkers 40 can be driven by a camming profile 46 which is movable relative to the sinkers. Sinkers 40 are further guided in their oscillations according to relevant radial planes by a guide reed or comb formed by the perimetrical milling cuts of a crown element 48 secured below the annular element 18. All the assembly 12, 14, 16, 18 may be raised by a sliding relative to the cylindrical column 10. In order to make the guiding and balancing of said assembly easier, tubular columns 50 may be provided and carried by the plate 5. These cooperate with large pins 52 carried by the flange part 14, to slide into the columns 50. Springs 54 wound up around the columns 50 react between the fixed plate 5 and the flange part 14 to ease the lifting of said assembly 12, 14, 16, 18, for inspection purposes of the needle work zones, by raising the front of needles 24 formed by the element 18, relative to the front of the needles formed by cylinder 7. In place of springs 54, pneumatic cylinder-piston systems may be provided. The two fronts are also guided in their relative axial slides and are secured against relative angular displacements (in addition to columns 50 and other suitable mechanical arrangements) by means of conical positioning pins and/or guide skids 56 engaged to cylinder 7 and capable of sliding relative to seats or guide-appendixes 58 secured to the element 18 and extending downwardly at positions in which there are no needles in the two fronts and where there is no article between the needles since there are provided sets of spaced apart needles which operate separately from each other along the periphery of the annular working zone of the two needle fronts to make separated products.

With the two needles fronts received into the channels of cylinder 7 and element 18, which are stationary, respective contours of cams having annular, continuous or discontinuous development cooperate, which contours of cams rotate by continuous motion, one in opposite direction to the other, according to the same main axis of the machine. Number 62 indicates cam supports, whose cams are intended to act on needles 9 of the front formed by the cylinder 7 and on selectors or jacks combined with these needles. The supports 62 are mounted on an annular, continuous or discontinuous seat 64A of a ring 64 which is mounted for rotation by means of a rolling bearing 66 on the plate support 3. The ring 64 has an inner crown gear 68 meshing with a gear 70 mounted on a side vertical shaft 72 which is supported by the plate support 3 and by the plate 5 through suitable bearings. Shaft 72 is caused to rotate with continuous motion by a motor 76 through a trapezoidal belt drive 78 or the like. Besides the gear 70, a second gear 80 is engaged to the shaft 72 which meshes with a crown gear 82. This crown gear 82 is mounted at the lower end of a shaft 84, which is advantageously of tubular structure, and which extends on the inside of the cylindrical column 10. Shaft 84 is mounted to column 10 through a bearing 86. Radial camming profiles 88 are fixed solidly to the lower end of shaft 84 to produce driving actions that are synchronized with the relative rotation between the fronts and the driving cams. To this end, profiles 88 drive the main program drum 89. The shaft 84 has at its top end, longitudinal slots for engaging the tubular hub 90A of a disc 90, which is peripherically guided at the inside of the flange part 14 through a rolling bearing 92 similar to 66 and cooperating with the rolling bearing indicated by number 86. On the disc 90 an annular mantle 94 is mounted at the periphery of which a continuous or discontinuous seat 94A is formed for cam supports 96 analogous to those indicated by 62 and whose cams are intended for acting indirectly on radial needles 24 of the front made up of the annular element 18, in the way indicated hereinafter. The cam supports 96 are in front or outside of the cylinder 16 for driving the jacks or selectors housed in the channels 16A.

The kinematic system supplied by motor 78 causes supports 62 and 96 to rotate with equal and opposite motion through the gears 70 and 80 meshed one with inner crown gear 68 and outer crown gear 82 respectively, from which the reversals of rotation direction result.

To accommodate the raising of the assembly 12, 14, 16, 18 and thus also of elements 90, 90A, 94, 96, the hub 90A is coupled by a sliding fit to shaft 84 in order to maintain the kinematic coupling, and the stability in the lowered work position of said assembly is ensured by a latch 98 carried by the annular mantle or shell 94 and which can be engaged into a seat in the upper part of the shaft 84.

The cam supports 62 have cams that are able to act in the traditional way both on the butts or heels of needles 9 and on those of underlying selectors or jacks 102 and 106, the latter being of oscillating type to operate the selections through rows of removable butts that are able to cooperate with thrust cams acting in radial, centripetal direction and with lift cams acting on lower thrust butts 106A. This selection arrangement is of substantially traditional type in the presence of a relative motion between the front and the shell or contours of the cams, in the present instance the front 7 being stationary and cam supports 62 for needles and cams 36 for sinkers 26 being in rotation.

The cam supports 96 carry, at the lower end, the camming contours 46, already indicated, to control the oscillation of sinkers 40. Said supports further carry cams, like those designated by 122 and 124 and shown for exemplification, of a set of cams able to act on oscillating selectors or jacks 126 substantially operating like those indicated by 106 and on jacks 128 that also oscillate. The jacks 128 have at the bottom a heel 130 and an appendix 132 extending at right angles. This appendix extending at right angles is capable of pushing the needles 24 outwardly in the radial direction by acting on the inner end of these needles. These needles have each a pair of upper butts 24A and 24B, which are able to cooperate with sideboard cams 136 capable of giving definite drives to the needles, in cooperation with the drives effected by the end or appendix 132 of selectors or jacks 128. The camming contours 136 are carried or formed by an annular body 140, which is carried by and fixed to the lower end of supports 96, said annular body 140 being either continuous or discontinuous. The body 140 forms the contours 136 which are intended to act on butts 24A for driving of needles 24 for radial inward motion only, as well as contours 142 and 144 that are able to act in radially opposite directions outwardly on the heel 130 of each element 128, 132. The needles are advanced radially outwardly by jacks 128 or by cams 150 and 152. It should be noted that jacks 128, besides oscillating, can also be lifted and lowered to lose contact or make contact with contours 142 and 144.

The number indicates pneumatic openings for retaining cut threads, which are located at lengths of the work front lacking in needles. The number 149 openings or inlets for sucking articles which are forming.

FIGS. 2, 3, 5, 7, 8, 9, 10 show various positions both of jacks or selectors 128 for driving the needles and of camming profiles cooperating with them and with needles 24. The individual sets of cams assigned to the various controls of needles 24 may be predisposed with mobile parts so as to obtain controls for radial, centrifugal displacement of needles 24 which differ to whether the needles must or must not clear the stitch in order to form float or tuck stitches. For the needles 9 of the cylindrical bed, the cams—either stationary or mobile—are instead, traditional. By 150 vertically sliding elements are indicated which form cams that are able to act on the heels 24B, in order to move the needles 24 radially in the centrifugal direction up to a position in which the stitch is not clear (tuck level). Further vertically sliding elements 152 form cams capable of further moving needles 24 from the tuck level to the clear level where the stitches pass over the open latches. During these movements—which serve to form the clear or plain stitch—all the needles are driven in the same way and the jacks 128 are not used and thus remain lifted (FIGS. 9 and 10). To drive the elements 150 and 152, lever elements 150A and 152A are shown which are articulated on supports 96, on which camming tracks 122 and 124 for controlling jacks 128 are provided. These levers are driven by connectable and disconnectable cams carried by an external stationary structure. When plain stitch is to be formed, cams 150 and 152 are connected, thereby, all needles clear the stitch and form the plain stitch. When the micro or tuck stitch is to be formed, the vertical pole cam formed by the element 152 is raised and jacks 128 are actuated to be selectively lowered by selection systems 126 or by other equivalent selection systems. The lowered jacks 128 have the heels 130 at the level of contours 142 which thus cause jacks 128 to oscillate from the position of FIG. 7 to the position of FIG. 8, thus causing respective needle 24 to advance—similarly to cams 152, but in a selective way—for clearing the stitch, with the selection criterium provided by the oscillating jacks 126 or by other equivalent means. The needles which are not actuated by jacks 128 are pushed only by cam 150 at the tuck stitch level. In every case, the contours 136 cause the needles—which had been made to advance centrifugally in any of the above mentioned ways—to come back the centripetal direction.

Figure 4:
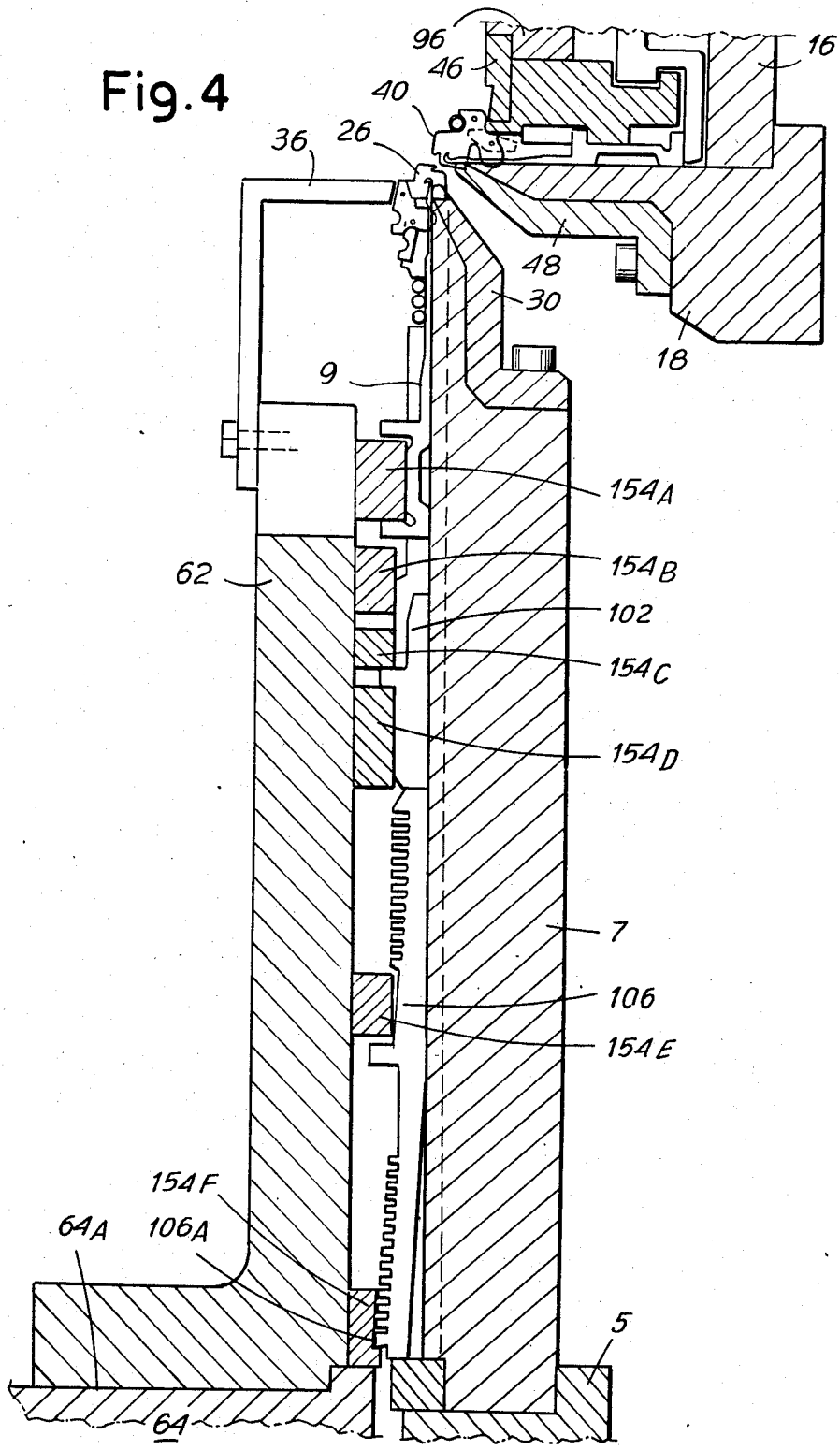
FIGS. 4 and 5 show progressively enlarged details of FIG. 2.
Figure 5:
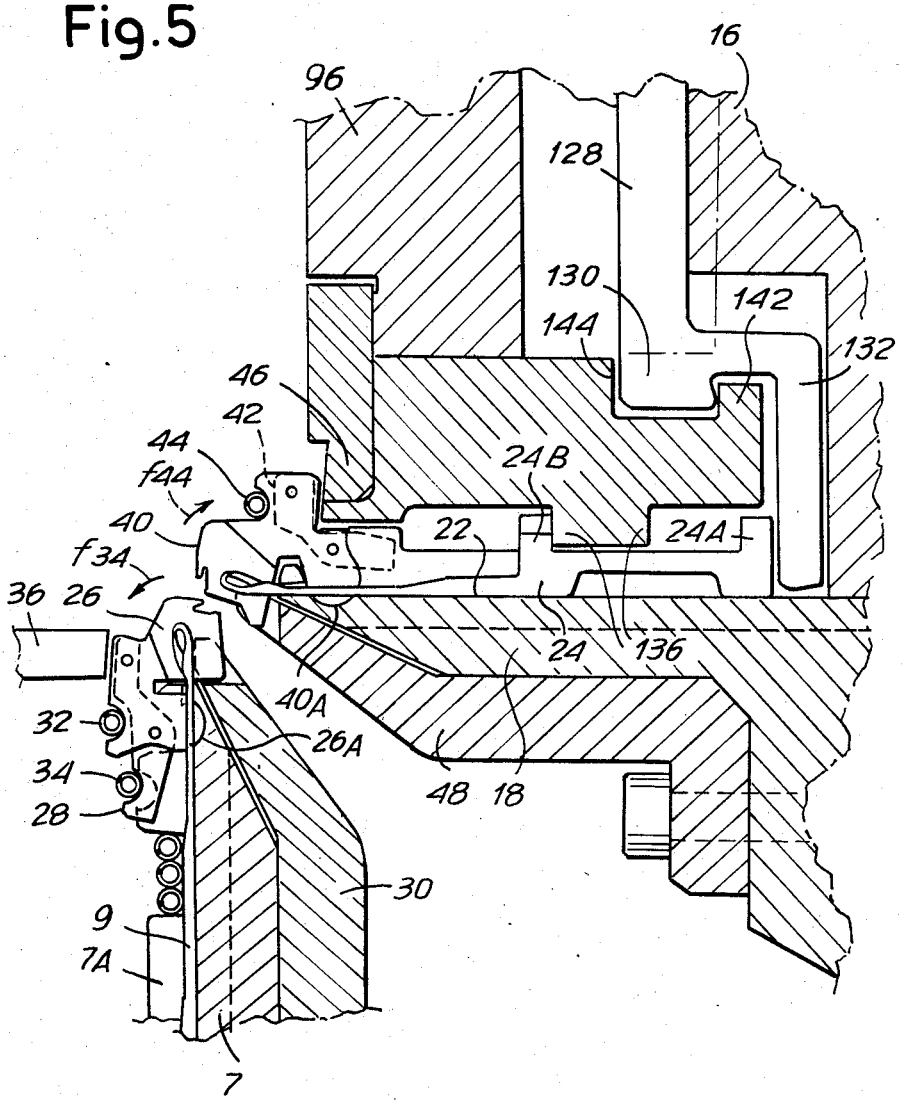
Figure 6:
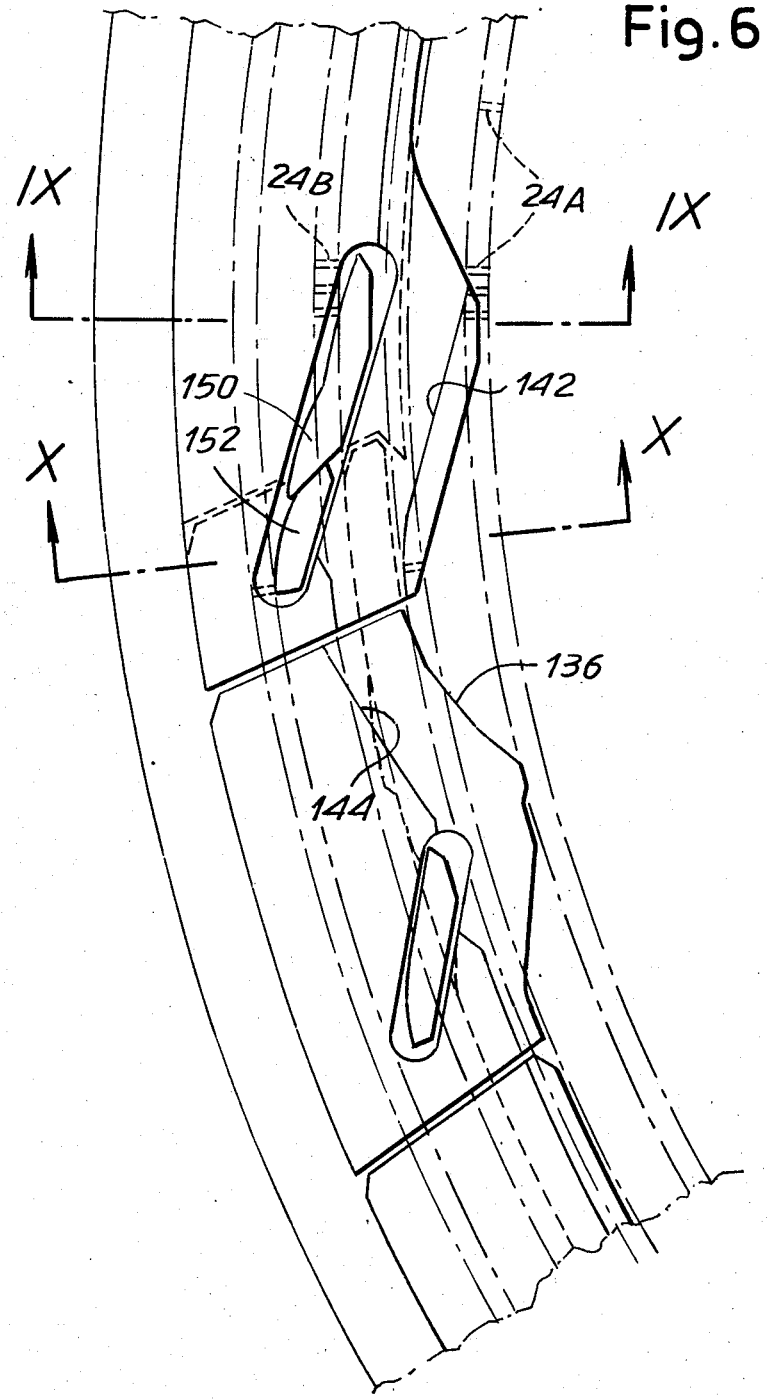
FIG. 6 shows a portion of a set of cams for driving needles of a discoidal front.
Figure 11:
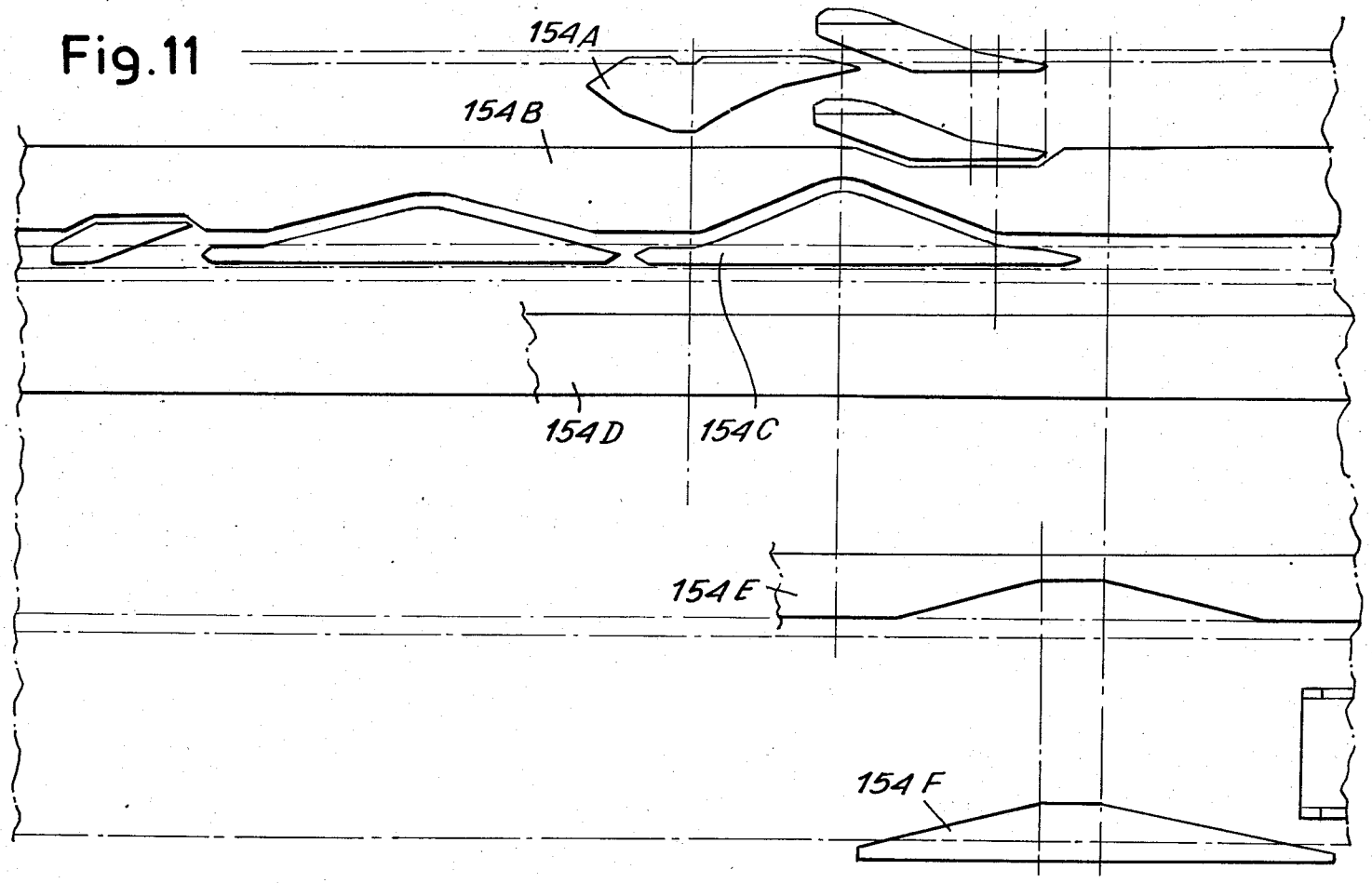
FIG. 11 shows a portion of a set of cams for driving needles of a cylindrical front.
Figure 12:
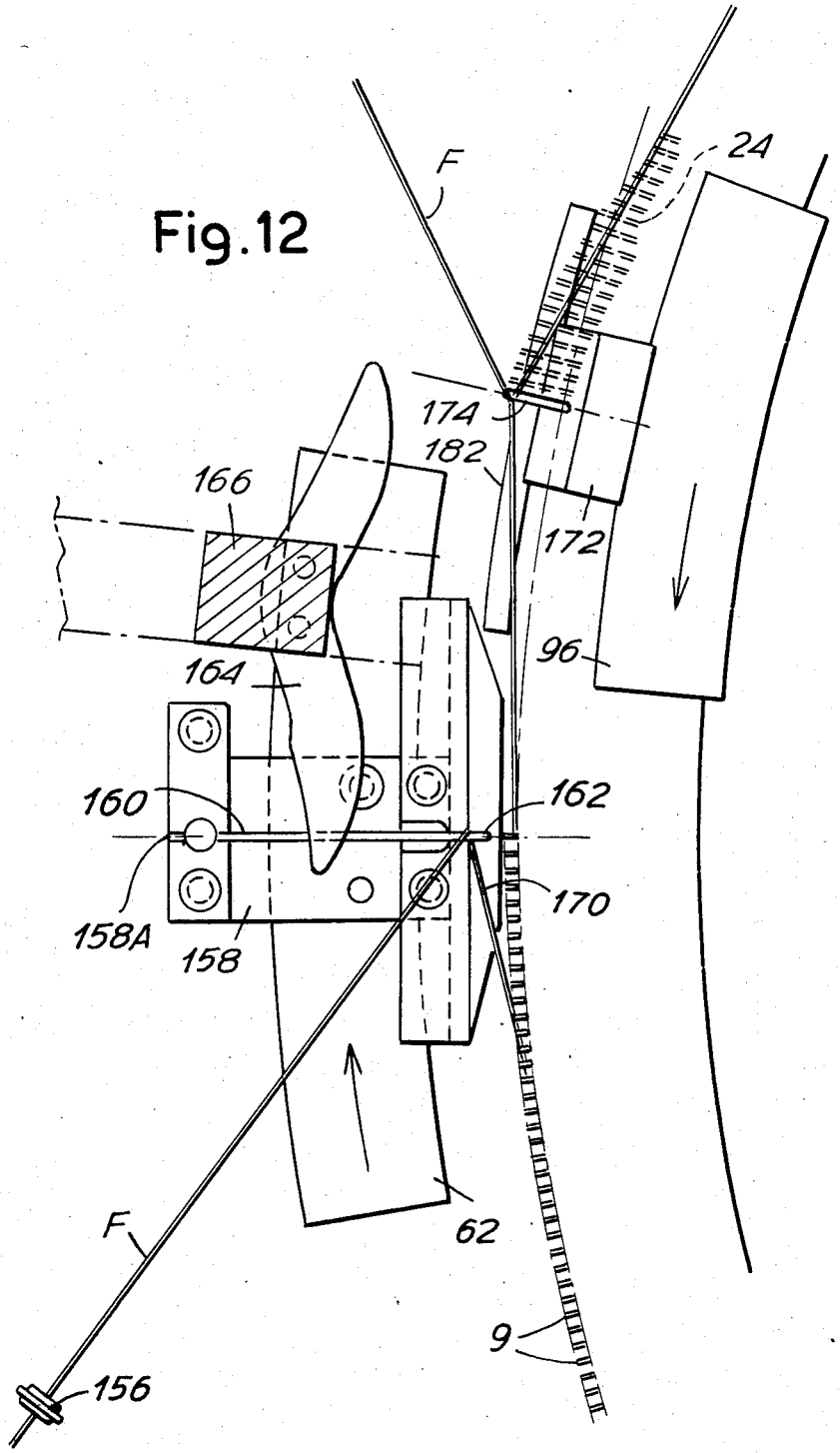
FIGS. 12 to 14 show a rough plan view of two views in radial section illustrating devices for drawing the thread with reciprocating motion.
Figure 13:
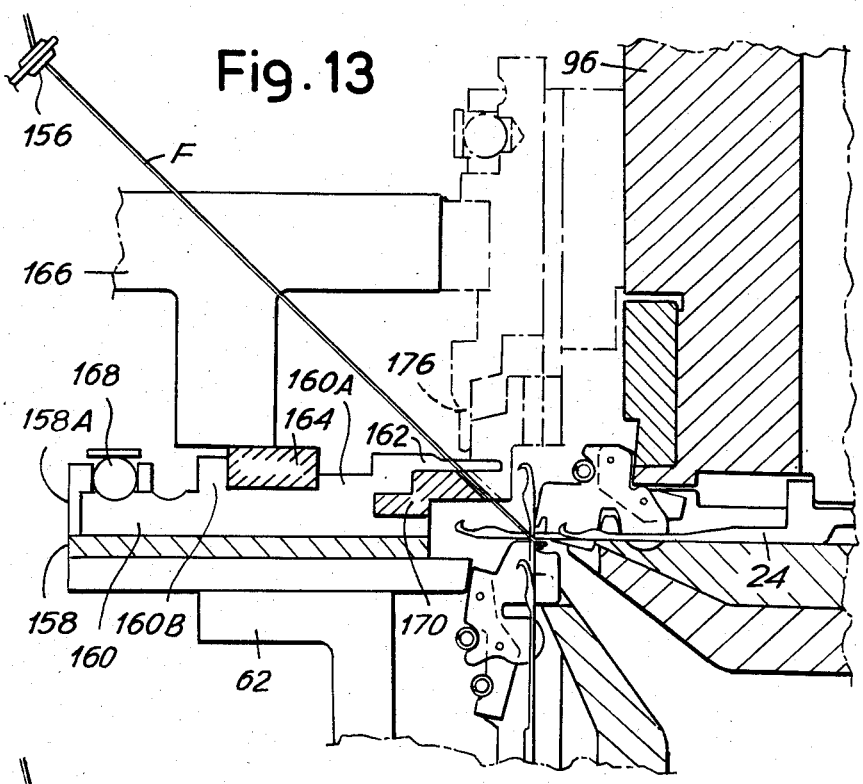

In FIGS. 4 and 11 cams 154A, 154B, 154C, 154D, 154E, 154F are shown able to act on needles 9 and on selectors or jacks 102 and 106 for the selection of needles of cylinder 7.

Figure 16:
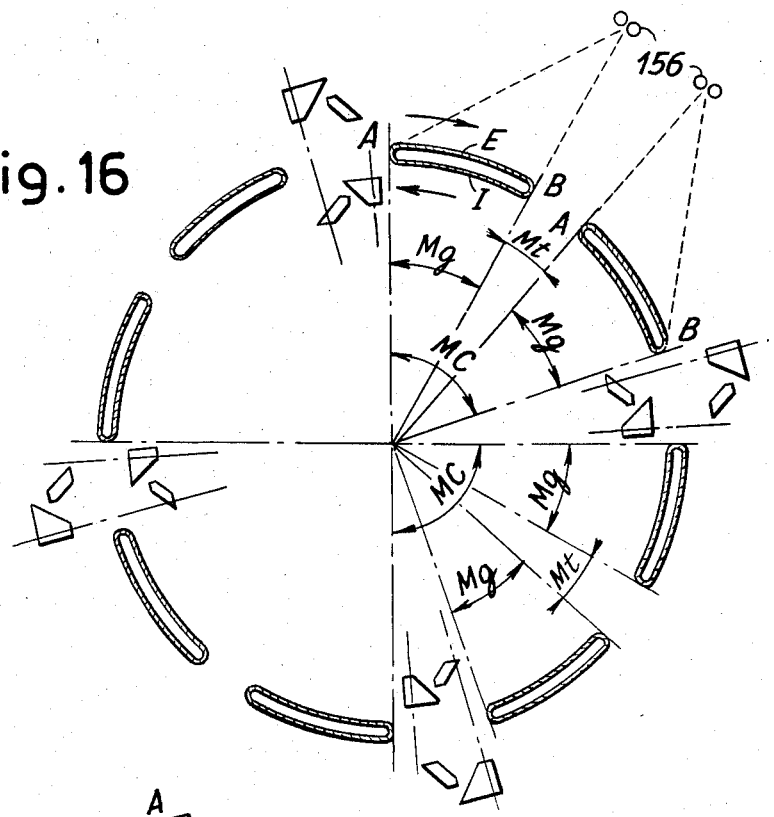
FIGS. 16 and 17 are illustrative operation diagrams.
Figure 17:
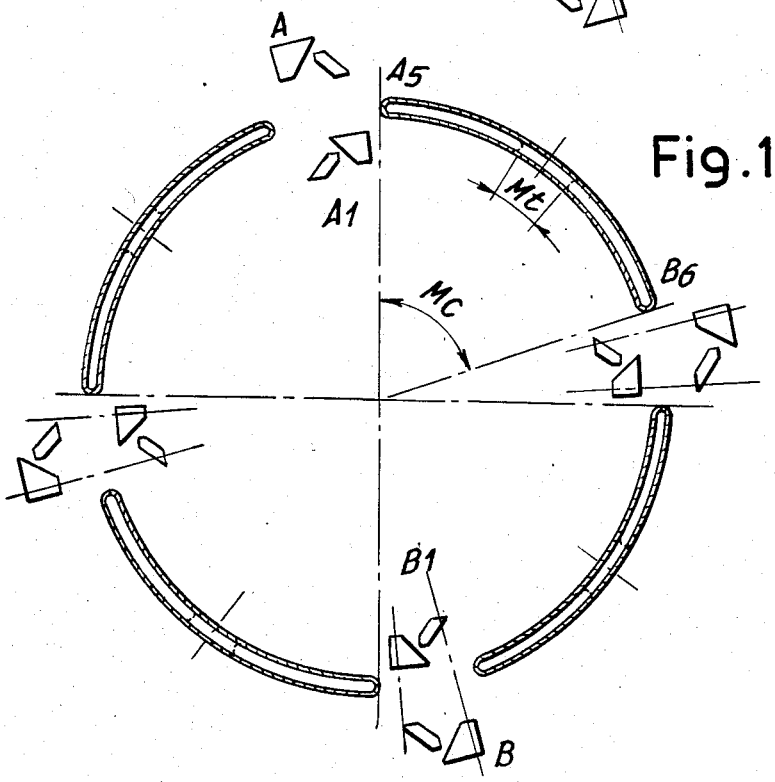

The sets of cams of the two fronts (FIGS. 6 and 11) are schematically illustrated in FIGS. 16 and 17.

The sinkers cooperating with the needles 9 and 24 are driven by the contours 36 or 46 to cooperate in time with them.

In the present machine, the needle beds (made up of parts 7 and 18) are stationary and the cam shells or mantles 62 and 96 rotate in opposite direction and with continuous motion. The thread must be fed in time to needles 9 which are axially lifted and to needles 24 which have radially advanced, through means (operating as thread-guides) which must perform the drawing and intervene in time by moving along definite arches of needles. Two different sets of such thread-guide means must cooperate with eath other to draw the thread alternatively in the two directions, concordantly with the active cams of the shells 62 and respectively 96, during the action of needles 9 and respectively 24.

The cams which control the needles of the two stationary fronts, are carried by equipment which rotates in opposite directions with continuous motion. Besides, the cams for one front must cross those for the other front, in correspondence with stretches of fronts spacing out arches of active needles which are to form the tubular fabric. This is schematically illustrated in FIGS. 16 and 17.

According to the illustrated example, four pantyhose or collant articles are formed simultaneously. For this purpose there are provided (see FIGS. 16 and 17) eight arches of needles Mg which are intended to form the hoses of the legs. These arches Mg are subdivided into four pairs each of which is intended to form the legs of a same article. Each article is completed by a bodice, which is formed by the needles of four sectors Mc including, two arches of adjacent needles Mg and the needles of the intermediate arch Mt, which are intended to form a portion of fabric equivalent to the so-called "gusset" which serves to join the internal parts of the legs. The arches Mg are obviously four if the arches Mg, limitedly spaced apart, eight in number.

In corresponding with each arch Mg of needles, a thread-guide eyelet 156 must be provided for the thread which is intended to form one leg. One of the two thread-guide eyelets 156 relative to a same arch Mc must be excluded during the formation of the body and the other thread-guide must be assigned to the feeding thread for the body. Alternatively, there may be provided, during the formation of the body, the intervention of a thread-guide that is different from the two which formed the respective legs by the needles of the two relevant arches Mg. It should be appreciated that each yarn herein considered may also be multiple, that is, at the substantial same position there may be two or even more yarns in order to replace the yarn according to required characteristics of the article to be formed.

Thread-guide eyelets 156 are fixed as are beds 7 and 16. For the drawing of the threads, finger elements are provided which are made to project and withdraw in time to engage the thread in order to draw it in the desired direction and to release it. These fingers are movable on the carriers including the supports or shells 62 and 96, at positions suitably advanced with respect to the cams responsible for the motions of the needles. In particular, in FIGS. 12 to 14 these drawing finger-like members are specifically illustrated.

On the support 62, or on each support 62 of the cams which are intended to drive needles 9, a block 158 is provided in correspondence with each of the cam systems carried by the same supports 62 for the lifting—and successive lowering—of needles 9. In the block 158 a radial seat 158A is formed for a plate that is able to constitute a drawing finger 162 for a thread or yarn F coming from a thread-guide 156. The plate 160 is driven to be operated for the drawing of yarn by a centripetal displacement and to be excluded from the drawing by a centrifugal displacement. Both these displacements are controlled by a contour 164 placed in a fixed position and carried by a supporting structure 166 which holds, for example, also the thread-guides 156. The contours 164 act on the heels 160A and 160B of each plate 160 and are disposed in correspondence with the separating spaces between the eight arches Mg. At least the contours 164 which are in correspondence with the arches Mt—included between the two arches Mg which are intended to form the legs of one article—may be excluded to prevent their operating during the formation of the body. A possible elastic peg 178 may be provided to hold the plate 160 and thus the finger 162 in the active centripetal position for the drawing of the thread along the arch comprised between two subsequent contours 164. Each block 158, besides forming a seat for the plate 160 of finger 162, forms also a latch-guard profile 170 for the known function of ensuring the integrity of the latch and their proper positioning in the zone of the needle lift.

The support or shell 96 for the cams which are intended to drive the needles 24, carries a block 172 which thus rotates continuously with the support 96. This block forms a sliding seat for a plate 174 similar to the one indicated by 160 and carrying a finger 176. This plate 174 is vertically slidable and presents its own finger 176 at right angles to that indicated by 162. This plate 174 is driven by a contour 178 similar to 164 and also carried in a fixed way (and in certain cases with a possible exclusion) by the structure 166. An elastic peg 180 cooperates with the plate 174, for keeping the plate in the lowered position, which is active during the travel between one contour 178 and the next. The block 172 carries a latch-guard 182 for the needles 24, in a similar way to the block 158.

The arrangement of plate 160 and 174 and their way of control are such that a finger 162, once activated with centripetal displacement, is able to pick up a thread F and draw it along in the direction of the displacement of its support or shell 62, to release it when same finger retracts, owing to the drive of contour 164. By adequate synchronism, a finger 176 of a plate 174 is inserted at the right time in active position to pick up the thread released by the finger 162 in order to draw it in the direction of its own support or shell 96 and then in the direction opposite to the preceding one.

When the legs are to be knitted, the thread for the formation of each of the two legs of an article is alternatively engaged by fingers 162 and 176 and alternatively displaced along the arch of needles Mg intended to form the respective leg. When the body is to be formed, one of the threads which have formed the two legs is excluded, and the other—eventually replaced—proceeds to make the body. The drive contours 164 and 178 corresponding to the respective arch Mt are excluded, thereby the same finger 162 and, respectively 176, draws the thread along the relevant whole arch of needles Mc. The exclusion of both the threads which have formed the legs may also be provided by the intervention of a different thread-guide eyelet to form the body, which thread-guide may be placed in a position substantially symmetrical to the respective arch Mc, and in this case, the position of the thread-guide eyelets 156 may also be symmetrical (see FIG. 16).

In the following the formation of the articles during a work cycle is explained.

Figure 18:
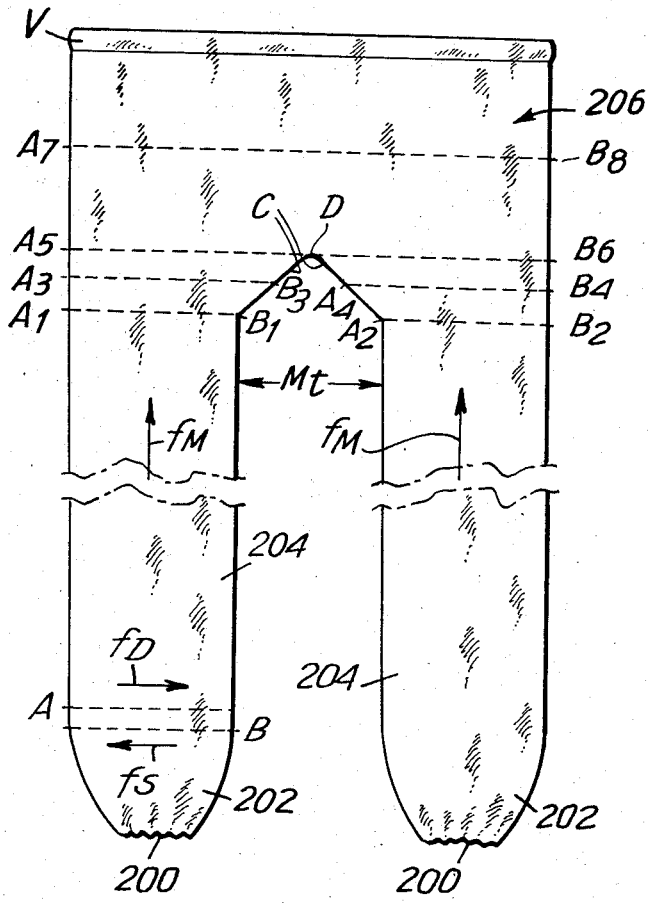
FIGS. 18 and 19 show a pantyhose article outline and schematic local sections of the same.
Figure 19:
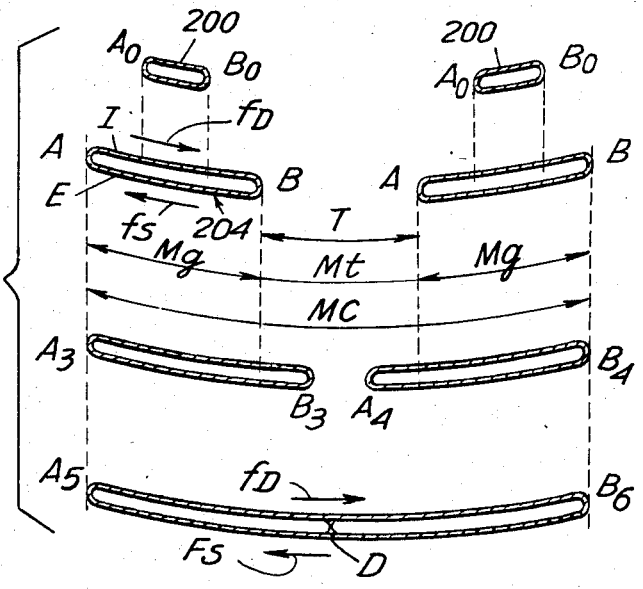

With reference to the diagrams of FIGS. 18 and 19, in order to form a single article out of the set of four pantyhose (collant) articles which can be formed simultaneously by the two fronts of the machine, at least a number of needles, for example at least 400 for each article and for each front, will be available, so as to form a collant in which each leg hose will be possibly formed through an arch Mg of about 200 needles in each of the fronts (thus for a total amount of about 400 needles) and in which the body or panties portion will be possibly formed through an arch Mc of about 400–440 needles for each front. The number of needles forming the body will likely be slightly larger than the sum of needles appointed to the formation of the two leg hoses inasmuch as the sets of needles Mg forming the leg hoses are spaced apart by an arch Mt made up for example, of a few tens of needles which are intended to form the zone of the so-called "gusset" of the crutch.

Upon beginning the article formation, a limited number of needles are inserted in order to start the formation of the article toes 200 in FIGS. 18 and 19. It is also possible to insert all the needles just on the first revolution and then proceed with the central needles and with progressive insertions of needles at the ends of the instantly active arch. Through a progressive insertion of needles, progressive around the central needles which form the toe 200, a closed toe 202 is formed, suitably shaped for each of the two legs, until the number of needles of the arch Mg for the formation of each of the two simultaneously knitted legs 204 are involved in the work.

As already pointed out, to form each of the leg hoses 204 starting from the end 200 and in order to form the toes 202, the work is made by feeding the thread by means of fixed thread-guide eyelet 156, which thread is drawn along (FIGS. 12 to 14 and 33 to 36) alternatively by a finger 176 of the carrier of cam supports 96 and by a finger 162 of the carrier of cams 62, and so on, always in the opposite directions shown by arrows f and fS. The thread F is transferred according to fD from point A to point B (FIG. 19), by a transfer finger 176 which is carried by the support 96 of the cams being instantly active on the assembly of needles 24 appointed to the information of the hose under consideration. The finger 176 is pushed downwardly to an active position to take the thread and draw it in time so that it can feed the first of the needles 24 at position A, driven for the formation of the hose, and it is retracted to abandon the thread after the thread has been fed to the needles of the arch Mg up to the last of needles 24 which is at position B and makes part of the set of needles 24 which is intended to form the internal front I of the hose. At this point, the thread F is released by finger 176 carried by the support 96 which has drawn it according to direction fD, and said thread F is engaged by the incoming finger 162 carried by the cam support 62 which, since it is made to project centripetally, engages the thread and draws it in the opposite direction, that is, according to direction fS, to move it from the point B along the arch Mg up to the point A, thus forming—by means of the timely driven needles 9—a row of the external front E of the considered hose 204, the actuated needles 9 being opposite to those indicated by 24, which have just ceased forming the row on the internal front I. The arch Ao, Bo, which has been considered, is very small at the beginning of toe at 200, and it grows during formation of toe 202 due to progressive insertion of needles 9 and 24 at the ends of each arch of working needles on each front of the leg hose under consideration. After that, the arch A, B remains constant during the formation of the leg 204. Upon each revolution of the cam that are rotating in opposite directions, there are formed—by as many threads—more annular rows E, I of stitches in an even number on the internal front I and on the external front E of each hose, and this number corresponds to the number of sets of arches Mg and to the number of cams operable of driving the needles and which pass subsequently in front of each arch of needles Mg (between points A, B) appointed to the formation of each leg hose. During the formation of the external row E by means of needles 9, the needles 24 are deactivated to be used and activated later for the subsequent formation of an internal row I, after a finger 176 of a support 96 has picked up and drawn the thread just released by a finger 162. Substantially, there are alternatively formed—for each leg hose of the eight being formed—a partial row I on the internal front of needles 24 through the run of the thread from point A to point B (arrow fD) and a partial rank E by the needles 9 on the internal front, through the run of same thread from point B to point A (arrow fS) to give rise to a whole annular rank. The thread at the end of an external stitch rank E formed by needles 9 is fed to needles 24 which are driven to form, in opposite direction, the stitch of the next internal row I, at the end of which the thread is conveyed again to feed the needles 9 in order to form the successive external row E, and so on.

Figure 14:
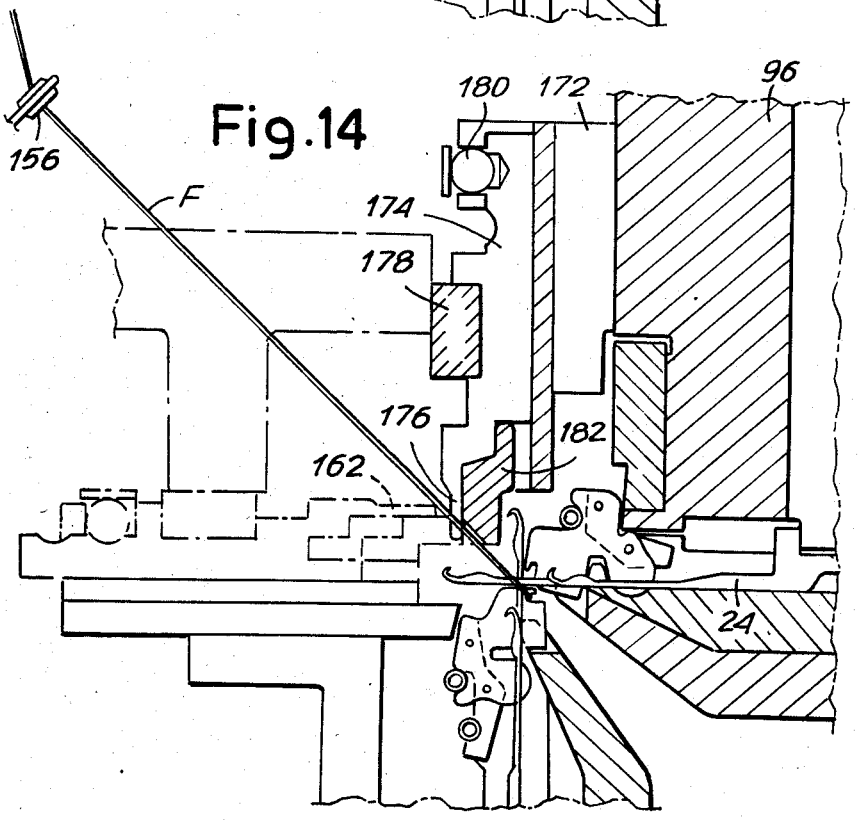
Figure 15:
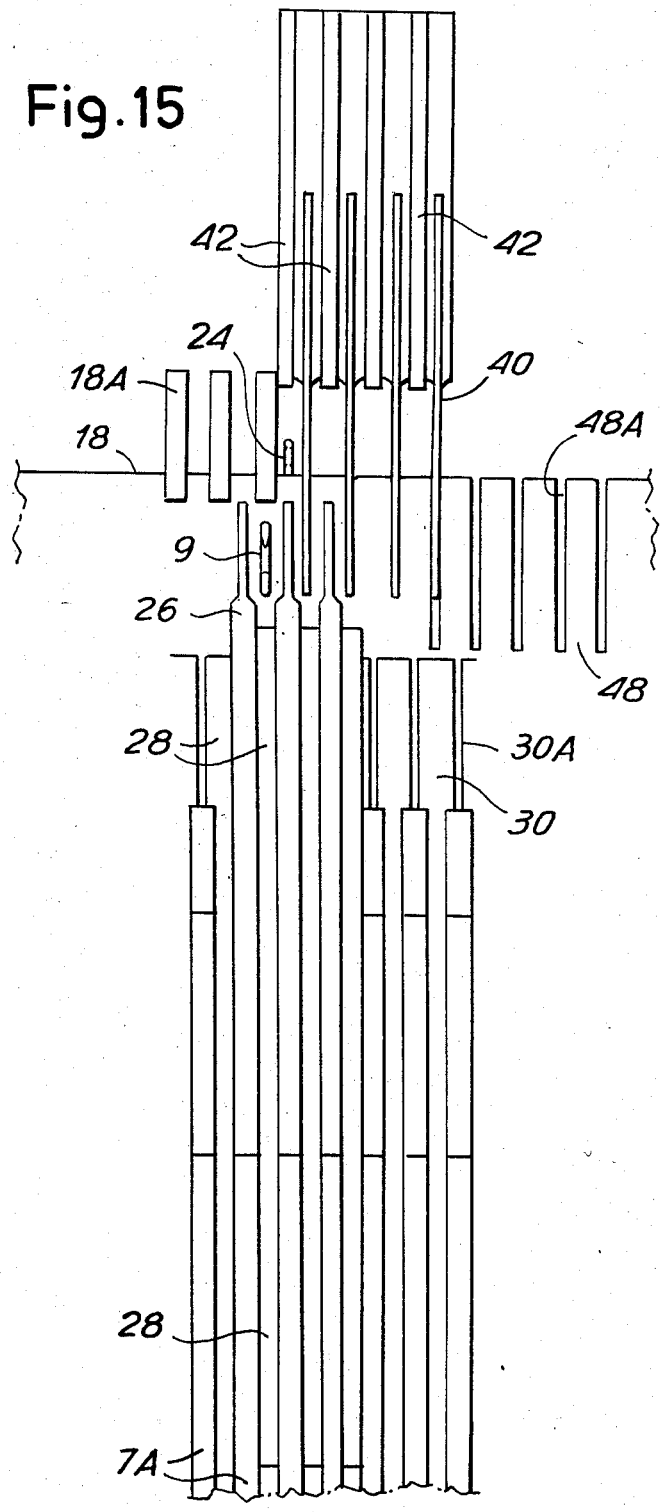
FIG. 15 shows a set of needles and elements connected thereto.

The introduction of the threads to the needles when knitting of the article begins from the toes, can be achieved as follows:

The thread F to be introduced is held by a trapper P of the type having a longitudinally sliding plate which acts both to hold the thread and to cut it (See FIGS. 14 and 33).

The trapper P is of a known type, e.g. in double cylinder machines, and is particularly suitable in the case in question, because it lends itself to be movable.

The trapper position is illustrated in FIG. 33, where it is up-stream of the needles Mg.

At the moment of introduction of the thread, the trapper must be brought to the advanced position of FIG. 33, so that the thread coming from the eyelet 156 and ending on the tip of trapper P, interferes with the trajectory of the finger 176 of plate 174 that it is of use to the needles of the disc or plate.

The thread F is thus drawn toward an arc of needles that are already coming out from the sinkers and are ready to receive it.

After the thread has been taken by the needles, the trapper opens—as shown in FIG. 34— and releases the thread that continues to be drawn by finger 176 to form the article.

After the thread has been introduced on the needles for working, the trapper must move backward—as shown in FIG. 36—to permit the succession of passages of the thread carrier block 158 which operates for the cylinder needles and moves in the opposite direction.

At the end of the formation of both legs, one of the two threads must be eliminated as the body is knitted by one only of the two threads which works on the whole length of the article.

The thread to be eliminated is taken and cut as follows:

The trapper P, acting now as a cutting member moves from the position of FIG. 36 up to the position of FIG. 34 with the sliding plate in its housing, after which it opens as shown in phantom line in FIG. 34, to extend the sliding plate.

In the meanwhile the thread to be eliminated—which is drawn by the finger 162—has arrived at the end of the needle arch (Mg). After that the trapper, now acting as a cutting member, rotates by the angle x in FIG. 35, whereby the open hook of the first needle interferes with the thread F.

After that, the trapper or cutting P closes, cutting the yarn on the side toward the needles and holding it on the side toward the yarn eyelet 156.

Subsequently the cutting member P comes back up to the position of FIG. 33.

Suitable arrangements should be adopted to avoid differences in the stitch lengths upon transferring the thread from the internal row I to the external row E. To this end, it might be possible, for example, to provide that the needles being at the ends of the arches Mg, perform a shorter run in order to produce stitches shorter than the others, thus compensating the likely longer stretch of thread used on the passage between needles 9 and 24 which are at the ends of the two arches Mg. To the same end, it is possible to act also on the stitch formation plane of the sinkers.

It will be useful to point out that, in this machine, the fronts of needles remain stationary, the cam mantles or shells, that is, the supports 62 and 96 and the relevant actuating units rotate with continuous, uniform and opposite motions, the thread-guide eyelets 156 are fixed and the only masses supplied with alternate motion are those of the threads F alternatively picked up and drawn by the projecting fingers of the two cam carriers rotating in opposite directions.

After formation of toes 202 and legs 204, with progressive formation of the articles according to arrows fM (FIG. 18), the point is reached where the formation of the body part 206 has to start, which part is joined to two adjacent leg hoses 204 simultaneously formed by the two adjacent arches Mg of needles 9 and 24. The needles 9 and 24 of the two arches or fronts Mg of adjacent needles A-B which are intended to form the two legs of the same collant, are spaced apart by the arch of needles Mt including a limited number of needles, for example in the range of 50–70 needles or even less. When the formation of the legs 204 is completed (simultaneously for all the articles under work) the fronts of the last ranks of a pair of adjacent legs is at position A1, B1 and A2, B2 (FIG. 18). At this point—according to FIG. 18—a progressive insertion begins of needles 9 and 24 external of the arch Mt to give rise to the formation of a joining profile C in correspondence with the crutch and of the so-called "gusset". The working fore portions of the two sets of needles 9 and 24 of the two fronts, which are to form the same collant article with two adjacent leg hoses 204, extend one towards the other, as indicated for the intermediate position A3, B3 and A4, B4 of the two working fore portions. As they arrive at level A5, B6, the two working fore portions of needles of the two fronts join at point D, and the formation of the body or panties portion 206 starts, with only one of the threads—which had formed one of the legs—being drawn alternatively along the arch A5, B6 and thus A7, B8, while the other thread, which had accomplished the other of the two legs, is excluded and cut out.

An initial insertion must be provided of all the needles at the A1-B1 and A2-B2, for only one row of the arch Mt, on both sets of needles 9 and 24 simultaneously, to produce closure of the crotch and then, the above-mentioned progressive insertion may begin.

At the end of formation of body 206, the article is finished in the traditional way with inverted edge and/or elastic fabric and with suitable final unthreading in order to form the edge along the waist line as indicated by V in FIG. 18.

To simplify the work, the needles of the arches Mt may be inserted simultaneously (rather than progressively), that is, passing direct from ranks A1-B1 and A2-B2 to that indicated by A5-B6.

In the last analysis, by means of the machine as above described and through the procedure as defined above, having at its disposal a number of needles in the range of 2000 for each front, four collanat articles can be realized on the same machine, which articles are formed, on the same machine, complete with toes 200, 202 already closed and shaped as indicated by C and with a body 206 directly formed on the machine without problems of continuity with respect to the legs and without the need for any coupling, and finally, with a finishing along the terminal edge of the waist line. Each article is therefore complete when detached from the machine.

Each feed of thread may be double at points slightly spaced therebetween and the two threads may be drawn by two different fingers. The described method and machine may form more tubular articles simultaneously, like stockings or other, or panties or other.

The machine may also be realized without sinkers and with suitable means in place of said sinkers.

Referring now to FIGS. 19 to 22, 301 indicates the cylinder of the needles and, 303, indicates the annular element or disc which makes up a second front cooperating with the one made up of the needle cylinder 301. Into the slots of the needle cylinder, the latch needles 305 slide, and, into the discoidal front 303, the needles 307 slide, being also supplied by latches. Within suitable channels of the cylinder 301 plates 309 are firmly fitted, which serve to make up the longitudinal slots for the sliding of needles 305. These plates 309 extend beyond the upper edges 301A of the cylinder 301 to extend the guide sideboards of needles 305, and finish up with a part 319 which is thinned and symmetrical with respect to the thickness of each plate 309. This thinned plate 319 of each of the plates 309 constitutes a fixed sinker which replaces each of the traditional sliding and oscillating sinkers provided in traditional fronts of needle cylinders or other types of fronts. According to FIG. 20, these fixed sinkers, formed by the thinned parts 319 present a contour (or profile) 321 which defines the pulling-down plane and above it they present a restraint hook 323 similar to that of the mobile sinkers and extending on the upper part with an arched profile 325 markedly convex for supporting the thread; in this way the thread may slide along the arched profile to pass over the hook 323 and reach the pulling-down plane defined by the profile 321. Similarly to what has been described for the cylinder 301, the other front of needles 307, formed by the disc 303, has a series of plate 327 which extend beyond the circular periphery of disc 303, said plates having a thinned part 329, shaped with a profile 331 defining the pulling-down plane, with a hook 333 having the function of the hook of the mobile sinkers, and with a convex profile 335 overhanging the hook or crook 333, with an arrangement analogous to the one of the parts 321, 323, 325 of the fixed sinkers of the cylinder.

Figure 21:
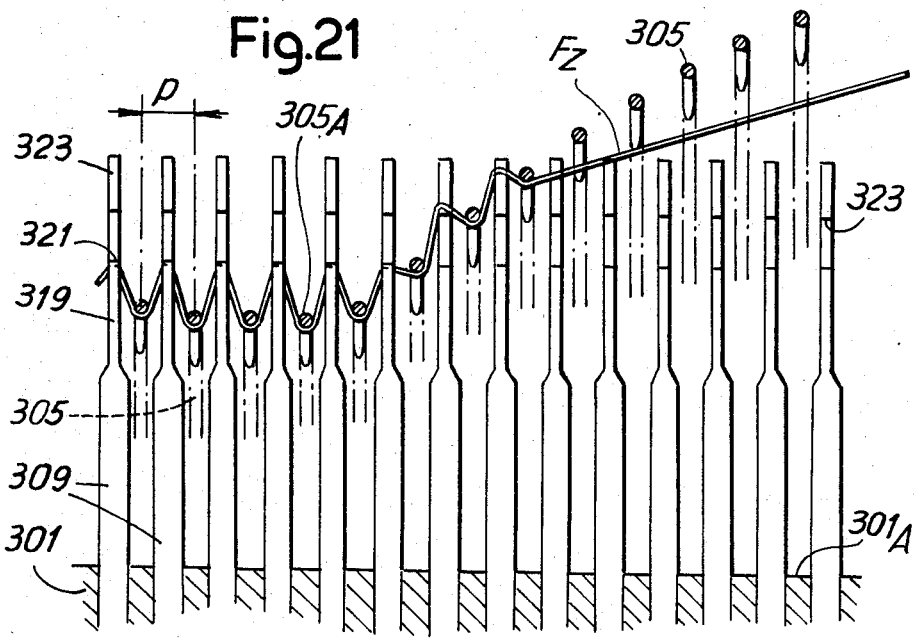
Figure 22:
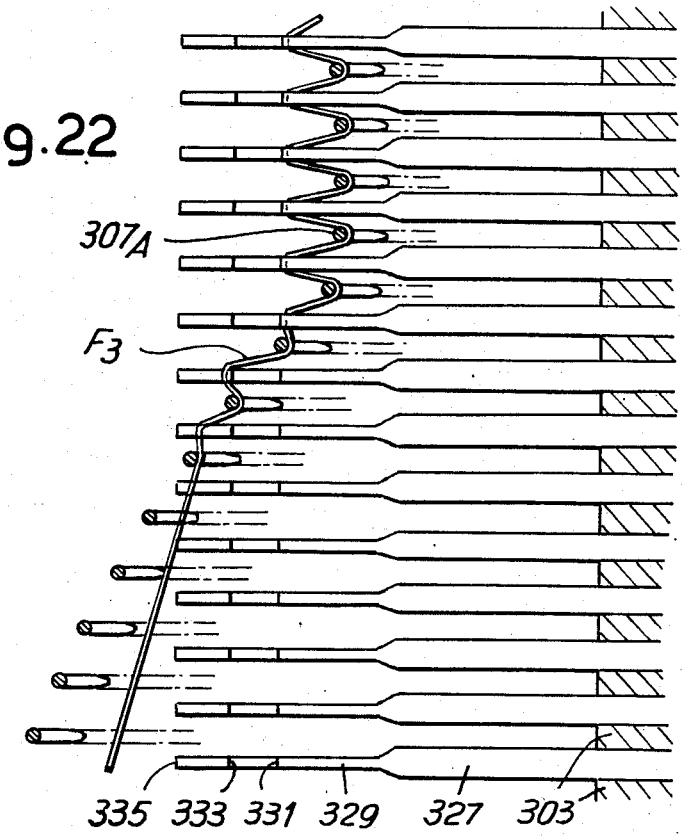

The fixed sinkers made up of the thinned zones 319, 329 described and shaped as indicated, are fixed elements which allow to obtain the same effect given by mobile sinkers; the fixed sinkers of a front may be brought very close to those of the other. In FIGS. 21 and 22 by F2 and F3 the thread is indicated in the arrangement which it takes before a needle reaches the point of maximum descent, in which the needle hook takes the position indicated respectively by 305A and 307A in FIGS. 21 and 22. It should be noted that the thread, by resting on the back profile 325 and 335 respectively, takes a waving attitude causing a relatively high absorption of thread prior to the settlement of the loops between the needle crook and the profiles 321 (or 331 respectively) defining the pulling-down plane.

The sinkers made up of the thinned parts 319, 329 are in correspondence the ones to the others and, similarly, also needles 305 and 307 are in correspondence the ones to the others and thus must be driven in an alternate fashion to avoid interferences. On the other hand, the formation of tubular articles in the way indicated hereinbefore, requires an alternate working of the needles of the two fronts.

Figure 20:
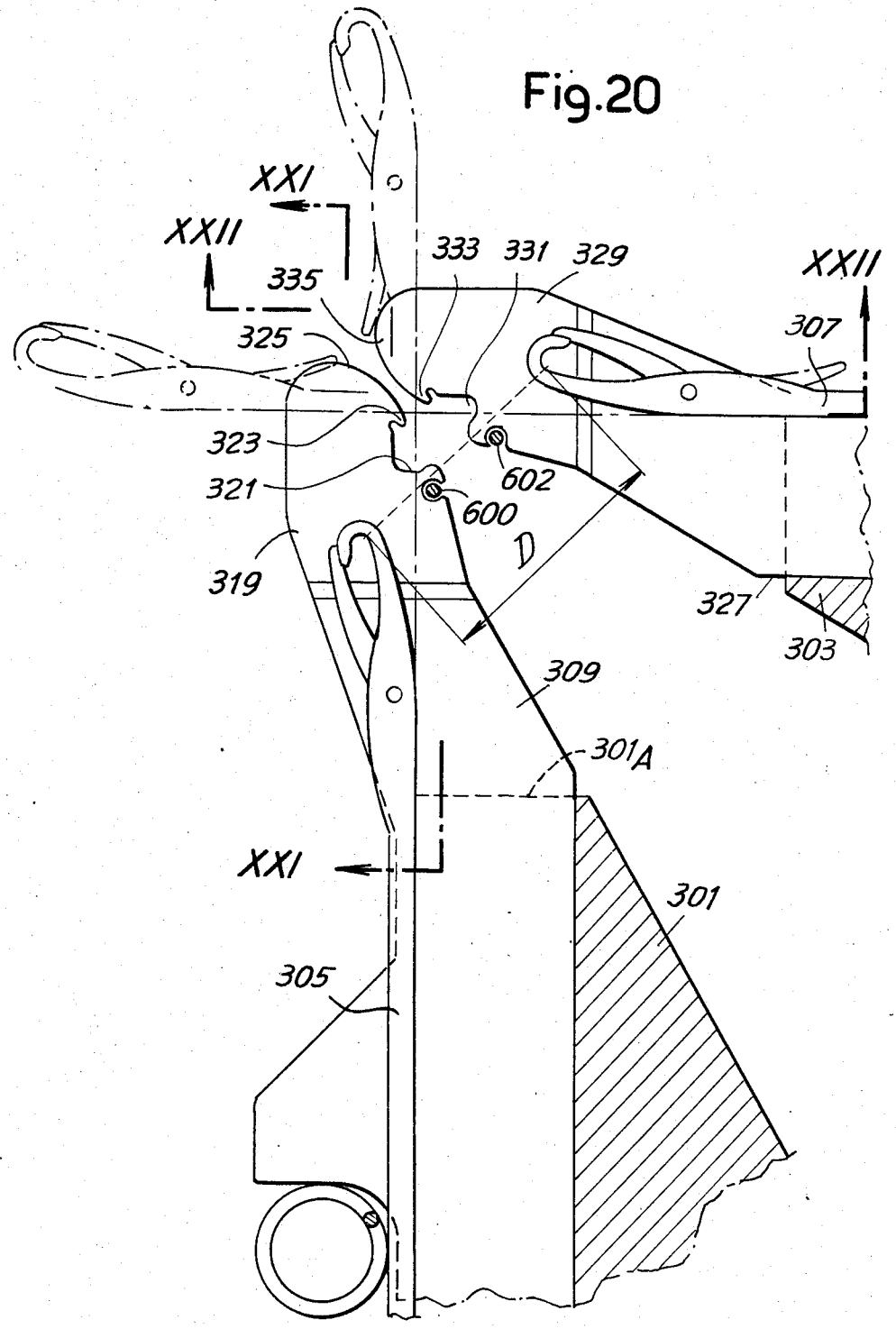
FIGS. 20, 21 and 22 show a local section of an embodiment having fronts with fixed sinkers, and also an internal view of the sinkers of the cylinder and, respectively, an internal view of the sinkers of the disc or plate, to illustrate the arrangement of the feeding thread in contact with the heads of the fixed sinkers before the needle reaches the point of its maximum descent.

The shapings of the thinned parts may be modified relative to those of parts 319, 329 shown in FIG. 20, for several purposes. In particular, in FIG. 23 an arrangement is shown in which thinned parts 419 and 429 (corresponding to those 319, 329) are shaped without a hook profile but with extensions 432, 433 ending with rounded convex profiles 425, 435. Fixed sinkers like those of FIG. 23 may function without difficulty with the needle work zones very close together and thus with the cooperation of the extensions 423 and 433 on the fabric formed by the opposite front. Some difficulty may arise in certain cases upon the starting phase of the fabric formation, that in, when the needles of the two fronts are naked and must take the thread for the first time. To overcome this, there may be provided a start with alternate needles or an arrangement like that of FIGS. 25 and 26 described below.

Figure 23:
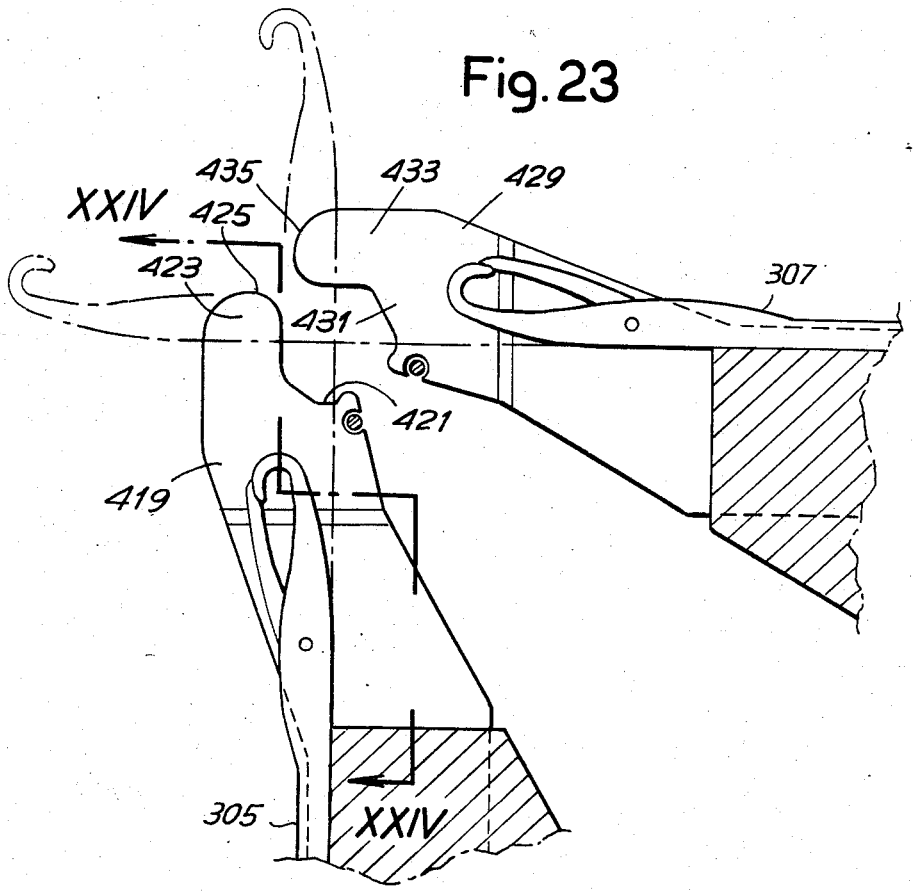
FIGS. 23 and 24 show a variant with respect to FIGS. 20 and 21.

With the disposition of the hookless sinkers as shown in FIG. 23, the thread arrangement is bettered with respect to what is illustrated in FIG. 21 and also in FIG. 22. In fact, the contact points of the thread F3 (see FIG. 24) take place only on the pulling-down plane which is defined by the zones of profile 421 and 431 respectively.

Figure 24:
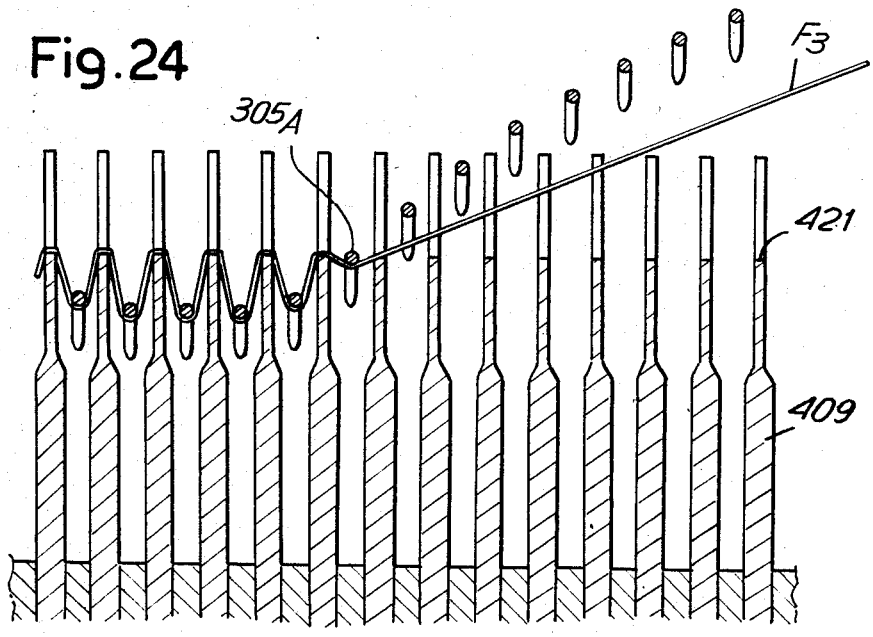
Figure 25:
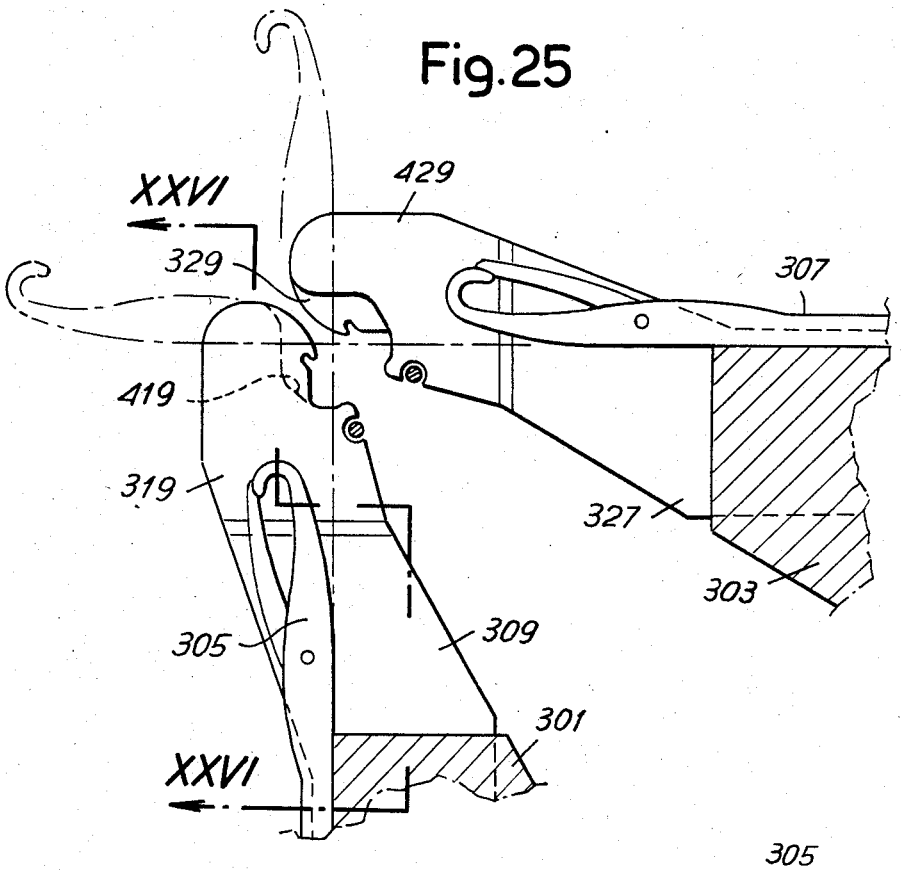
FIGS. 25 and 26 show, similarly to FIGS. 20 and 21, a combination of the structure of FIGS. 20 and 23.
Figure 26:
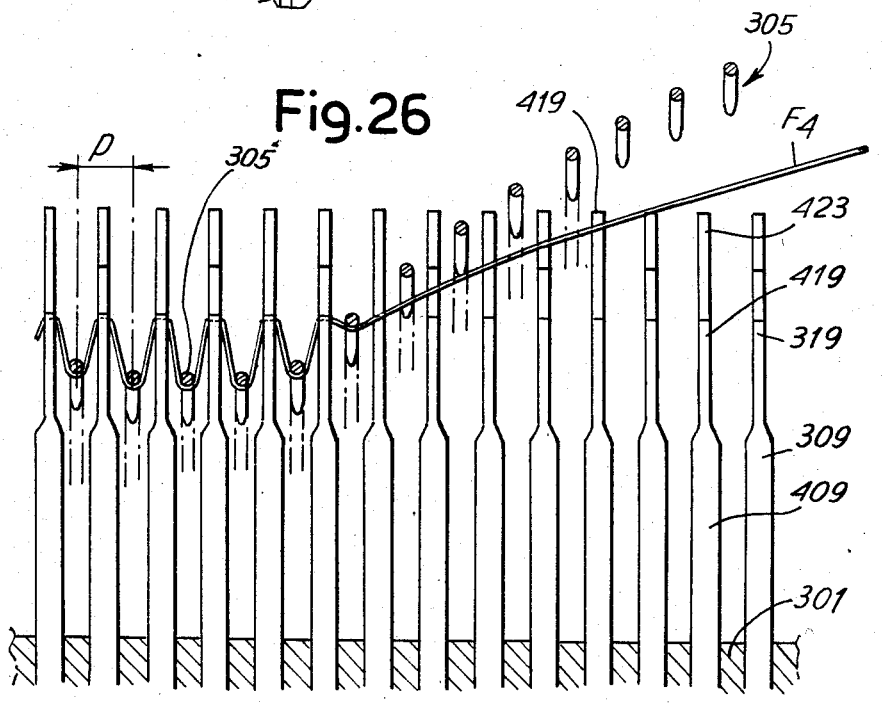

A disposition which permits to obtain advantages analogous to those of the solution of FIGS. 23 and 24, that is, with a thread path non particularly diverted before the stitch formation, is shown in FIGS. 25 and 26. By this disposition there is also obtained, without difficulty, the start of the working. According to FIGS. 25 and 26 there is provided a combined arrangement of fixed sinkers shaped with hooks as in FIGS. 20 and 22 and of fixed sinkers shaped without hook as in FIG. 23. In FIGS. 25 and 26, the fixed sinkers shaped in the two ways above mentioned are designated with the same references as those in FIGS. 20 to 24. Therefore, in the front of cylinder 301 there are provided alternatively sinkers 319 and sinkers 419, while in the front of the disc 30 there are provided, alternatively, sinkers 429 and sinkers 329. Preferably, a sinker with crook will be mounted in front of a sinker without crook in the opposite front. That is, a sinker 429 will correspond to a sinker 319 and a sinker 329 will correspond to a sinker 419. In this way thread dispositions are obtained as shown in F4 of FIG. 26, that is, with points of contact of the thread on the heads of the sinkers, that is, on the convex backs of the sinkers in a number less than the number shown in FIG. 21, and with a waving development little higher than that shown in FIG. 24. A compromise is thus reached between, on the one hand, the disposition of the individual thread slightly diverted during the needles lowering for the formation of the stitch and, on the other hand, with a possibility of a regular start of the knitted article by the naked needles. The alternation of the sinkers of two types may be different from that 1:1 being shown.

FIGS. 27 to 30 illustrate more clearly the disposition which allows the exclusion of a negative phenomenon which may appear during the working on two fronts when producing tubular fabric either rectilinear or circular according to the disposition of the embodiment of FIGS. 1 to 19. As already stated, the article is alternatively formed by a fore set of needles 305 of the cylinder front and with a fore set of corresponding needles 307 of the discoidal front. By means of needles 305 the article portion MN1 is formed and by means of needles 307 the article portion MN2 is formed. An anomalous zone of fabric may occur in correspondence of the ends of the two article portions MN1 and MN2, that is, at the zone MN3, when the thread passes from the set of needles 305 to the set of needles 307. This is because the pitch P1 between the needles 305 and between the needles 307 is less than the distance D between the needles 305 and 307 in the position usually lowered shown by solid line in FIG. 29. When this greater distance D respect to the pitch 1, exceeds a given percentage limit of the pitch P1, it may cause a longitudinal flaw to occur at the two opposite zones MN3 of the tubular article which is forming on the two fronts. This possible flaw is eliminated, in practice, by bringing as far as possible close together the two fronts and limiting the lowering of the needles in the individual fronts. An improvement may further be provided in order to reduce this occurrence of defect in the longitudinal zones MN3 of the article, as shown in particular in FIGS. 28 and 29.

According to FIGS. 28 and 29, at least an end needle 305E and at least an end needle 307E at the ends of the two fore sets of needles 305, 307 which are intended to form the two portions MN1 and MN2 of the tubular article, are longer than the normal needles 305, 307, as shown in FIG. 28 for the needles 305 and 305E. By X the difference in length is indicated which occurs both between the needles 305 and the end needle 305E, and between the needles 307 and the end needle 307E. The difference in length between the needles 307 and 307E may be different from the difference in length between the needles 305 and 305E. Two adjacent needles may also be provided—at each end of a work fore set—of greater height than that of the other needles, and such a greater height may be equal or different.

In each case there is obtained a minor distance D1 with respect to the distance D which would occur with usual needles, as shown in FIG. 29, where the hook points of the needles 305E and 307E are shown in dotted lines in the lowered needle position, whereas the positions of the needles 305 and 307 lowered under the same conditions, are indicated by solid lines.

In addition to what has been indicated above and for the same purpose of limiting said drawbacks along the end zones MN3 of the two article portions MN1 and MN2 formed by the two fore sets of needles 305, 307, there may be provided, at the position where the two article ends MN3 are formed, fixed sinkers having the pulling-down plane raised to a greater extent than that of the already described sinkers. In FIG. 29 alternating sinkers with hook are shown (which may be eventually alternated with sinkers without hook) and two special sinkers without hook which define the knitting edge in a vertical position raised respect to the pulling-down plane of the cylinder, and radially moved outwardly of the pulling-down plane of the disc, the level differences being indicated by LX in the two fronts.

The level difference of the pulling-down profiles in the zone of formation of lines MN3, which may be gradual for several sinkers, allows to limit the differences which, otherwise, could be remarkable in these zones MN3. Similarly, the differences in length of the needles allow to reduce the distance D1 among them respect to the distance D which would occur with usual needles.

Either or both the above conditions of the differences in length of the needles and the level difference of the pulling-down plane, make easier the formation of a very regular article.

In particular, FIG. 30 shows sinkers 519 and 529 of different morphology respect to that of sinkers 419 and 429 of FIG. 23. These sinkers 519 and 529 are predisposed as to have the pulling-down plane raised respect to that of the normal sinkers, in the points where the zones MN3 of the tubular article are formed. The morphology of these shaped sinkers 519 and 529 has the purpose of not causing the hooking of the thread on the ends 423, 433 or 323, 333, when, by means of the thread-guide, said thread reverses the feed direction by passing from one front to the other.

In some cases, it may be convenient to dispose a barrier against a possible slipping of the sinker loops out of the zones 321, 331; 421, 431, which can not be necessarily prolonged towards the other front. This barrier may be constituted by an open ring like that indicated by 600 or 602 (FIG. 20) housed in grooves or holes of the rods forming the sinkers.

Figure 31:
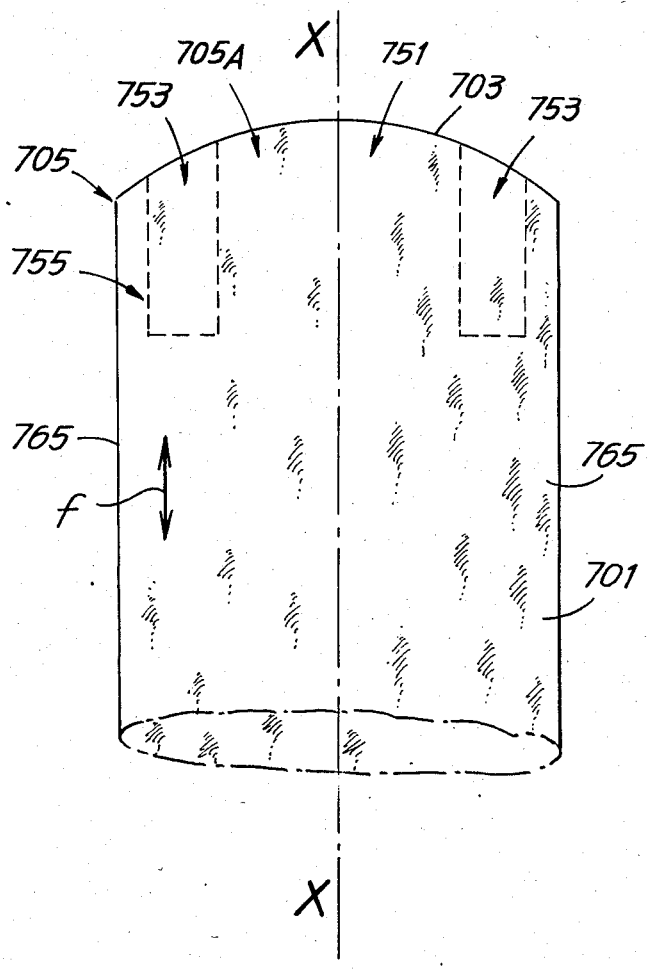
FIG. 31 shows a schematic view of a tubular article toe with its end being closed.
Figure 32:
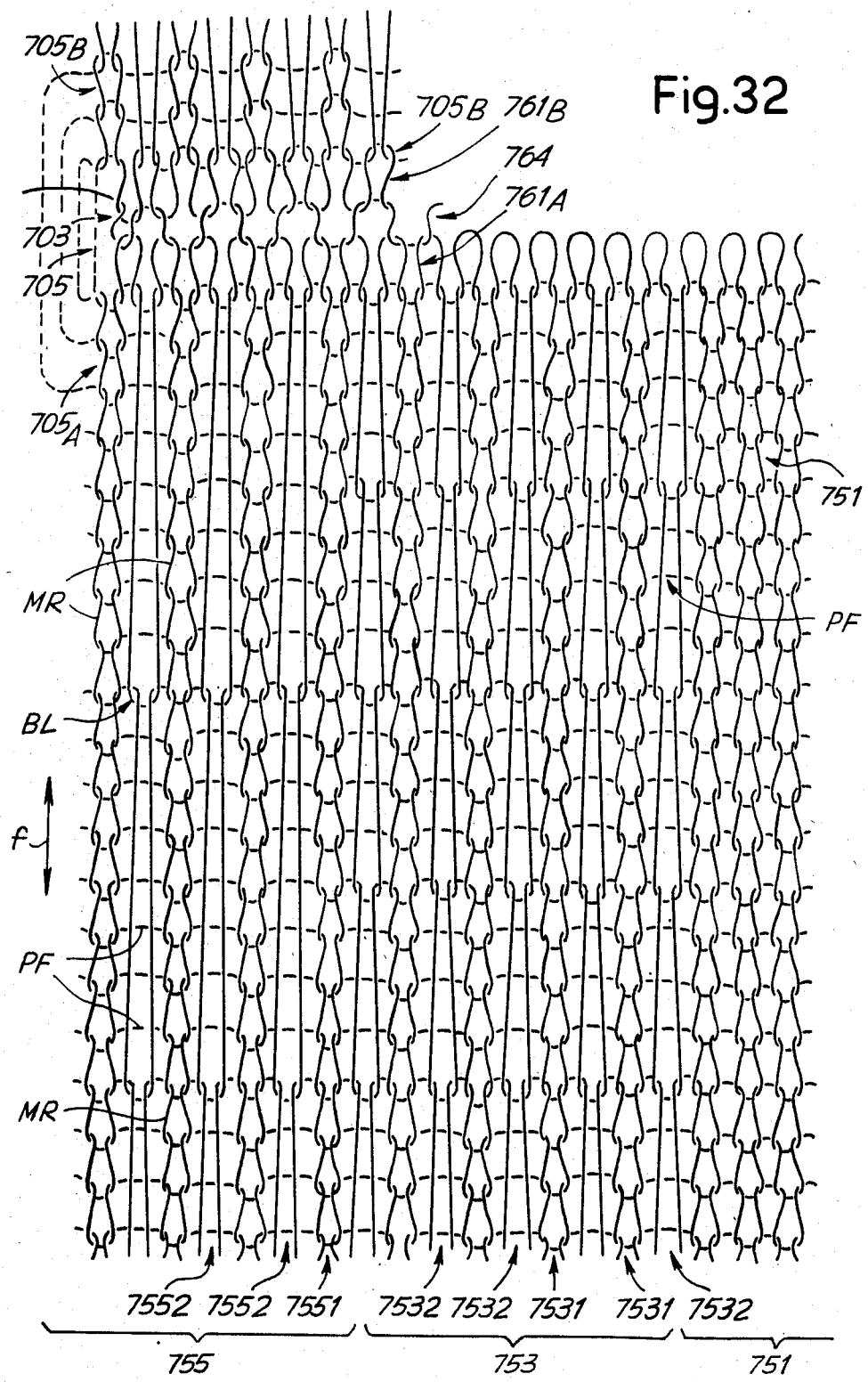
FIG. 32 is a fabric portion of a different article from FIG. 18, being developed to show its interlacement.

According to FIGS. 31 and 32 (showing a different article from that of FIG. 18), by 701 there is indicated the tubular fabric usually formed with float stitch or with tuck stitch or with plain stitch, this tubular fabric starting with a closure row 703. The zone of tubular fabric adjacent to the closure row 703 is constructed in such a way as to give the edge defined by said closure row 703—which is the initial rank—some curvature. This zone, which is called "toe" (as it can be represented by the toe of a women's stocking) is indicated by 705, and in particular, 705A and 705B indicate the two fronts and back edges of a flattened article shown in FIG. 31. These two edges 705A and 705B can be viewed when the article is opened in the zone of the closure rank, as shown in FIG. 32. The two edges 705A and 705B are to be considered practically symmetrical relative to the closure rank 703.

Supposing that the article is flat as in the arrangement shown in FIG. 31, the curved line, in which the closure rank 703 lies, is shaped through a differentiation of the fabric structure of each of the two edges 705A and 705B. This structure is symmetrical in each edge respect to the median chain-dotted line indicated by X—X, in case the shaping must be symmetrical. In the central portion, indicated by 751, the fabric is made up, for example, of plain or cleared uniform stitch which is shown at the right side of the drawing (see FIG. 32). The number 753 indicates two zones adjacent to the zone 751 and by 755, two further outer zones. In each of the zones 753 the needles form alternate floated points PF in the fashion of regular stitches MR. According to the outline of FIG. 32, in said zone 753 there are formed rows 7531 with all the stitches being set up, that is, with all the stitches being cleared and the rows 7532, alternated with those indicated by 7531 where the needles form three floated stitches and one cleared stitch as can be clearly seen in FIG. 32. In each of zones 755, the needles form floated stitches in a number greater than in the zone 753 being also alternated with rows of regular stitches. According to FIG. 32, in said zone 755 there are formed rows 7551 with all the stitches being set up, that is, with all the stitches being cleared, and the rows 7552, alternated with those indicated by 7551, where the needles form seven floated stitches and one cleared stitch. The row with cleared stitch in the wale of stitches 7552 of the zone 755 may correspond or less to some of the rows with cleared stitches in the wale of stitches 7532 of the zone 753. The alternation of wale 7531 and 7532 and that of rows 7551 and 7552 may be different from 1:1.

The loops (or curls) produced by the needles forming the stitch wale 7552 and 7532, which loops develop in the lengths of the respective floated stitches, are actually loops slightly longer than the common ones of the zone 751 and than those of rows 7531 and 7551; in the drawing, in FIG. 32, these loops are shown much longer than in reality, for sake of clarity of the drawing. This determines, in the zones 753, and in a greater extent in the zones 755, a shortening of the fabric structure in the direction of arrow f, respect to the zone 751 in which only cleared stitches are formed. This limited shortening of zones 753 and the even more shortening of zones 755 causes a modelling of the toe, thereby the edge 703 of the toe closing rank results curved as shown in FIG. 31 or even more marked.

In practice, it is also possible to arrange only two zones like those indicated by 753 or like those indicated by 755 rather than the four zones 753 and 755, or further pairs of zones may be arranged, with floated stitches in a greater number than that of zones 753 and 755, and all of them with ranks of floated stitches being intercalated with ranks of cleared stitches which grow in number from the central zone towards the periphery, that is, from the axis X—X towards the outside. Obviously, the symmetry of the zones like those indicated by 753 and 755 will be predisposed for articles which must have such a symmetry relative to the axis X—X, but, asymmetrical zones may be predisposed for articles for which such a symmetry can be required.

At the beginning of the article formation, along the closure rank 703 between the two edges 705A and 705B of the tubular article, one or more adjacent rows of cleared stitches will be advantageously formed as indicated by 761A and 761B, after that, the zones with floated stitches can start. Between the rows 761A and 761B, along the closure rank 703, a connection is made with a starting row which forms several thread bridges 764 between the stitches of the two ranks 761A and 761B. This forms closure of the toe ends for the tubular articles.

In FIG. 32, it is noted that the course 764 is knit first, followed by the course 761A and 761B.

Such a structure may be realized through two opposite fronts which create the two edges 705A and 705B connected between them at the ends along the connection lines 765 (FIG. 31), in which the thread, which has formed a rank of the edge 705A, passes from a front to the other to make up a corresponding rank of the edge 705B. A machine of this kind is illustrated in FIGS. 1 to 19.

The zones with floated stitches like those indicated by 753 and 755 will be able to stretch to a greater or less extent, either for requirements related to the shaping of the terminal edge 703 of the closure rank, or for complying with other aesthetical requirements. Especially for the closed ends of women's stockings, it is possible to combine these zones 753 and 755 with zones of special fabric for the formation of the traditional toe structure.

It is possible to join the threads of the non-worked stitches PF with the thread of the worked loops BL along the spaced apart rows, thus with tuck stitches rather than with floated stitches. There is thereby obtained, all the same, a shortening and thus a modelling of the article toe, even if with a rather larger thickening of the fabric.

We claim:

1. A procedure for the formation of hosiery articles like stockings, pantyhose and panties, comprising, simultaneously forming a plurality of pairs of adjacent tubular leg-like articles on two non-rotating circular arched fronts of needles and by threads reciprocating transfer means, the tubular articles having rows of knitted threads that are alternatively formed by the two fronts through sets of needles whose number may vary, subsequently joining the adjacent tubular leg-like articles of each pair of each other, thereafter continuing the formation of rows of knitted thread to produce a tubular panties body portion for a plurality of pantyhose articles that are simultaneously manufactured, and during a passage of the thread from one front to the other, shorter stitches are formed for recovering a possible thread excess.

2. A procedure according to claim 1, wherein for each pantyhose article one thread is used to form each leg-like article, and one thread is used to form the body.

3. A procedure according to claim 1, wherein at the beginning of the tubular leg-like articles short rows are formed that gradually grow by putting at work central needles in a limited number which is progressively increased to form shaped ends of the leg-like articles.

4. A procedure according to claim 3, wherein to initiate the formation of the body, stitch growths are effected from one leg-like article to the other by inserting one of simultaneously and progressively the needles of an arch of needles included between the fronts of needles which are used to form the two leg-like articles.

5. A procedure according to claim 1, wherein adjacent ends of the tubular articles there are formed zones with one of floated and tuck stitches, thereby forming in said ends a shortening of fabric in the longitudinal direction.

6. A procedure according to claim 5, including forming zones adjacent said ends with an increasing number of floated stitches for increasing the shaping.

7. A procedure according to claim 6, wherein longitudinal rows of stitches are intercalated with clear stitches and rows longitudinal of stitches are intercalated with one of floated and tuck stitches, rows of clear stitches being interposed with rows of floated or tuck stitches.

8. A procedure according to claim 7, wherein a zone shortened to a major extent presents a minor number of rows of cleared stitches with respect to a zone that is less shortened.

9. A procedure according to claim 8, wherein in order to accomplish symmetrical shapings symmetrical zones with floated stitches are provided.

10. A machine for the simultaneous formation of a plurality of hosiery articles of the type including stockings, pantyhose and, panties through the procedure of claim 1, comprising the fronts being circular coaxial fronts of needles, characterized by the fact: that said fronts are rotationally fixed; that with them two carriers cooperate, having continuous motion one in opposite direction to the other and one carrying means for selecting and driving the needles of one front and the other carrying means for selecting and driving the needles of the other front; that means, for transferring multiple threads are provided on said two carriers, in such a way as to alternatively draw each of the threads along a partial front of the needles of a plurality of fronts assigned to the formation of individual tubular articles, in order to alternatively feed thread to the raised needles of one front and then of the other front.

11. Machine according to claim 10, characterized by the fact of comprising means for selecting the needles to join in time two adjacent partial fore sets of each front which have simultaneously accomplished the two legs of several pairs of legs, and for effecting body portions joined to the two respective tubular leg articles.

12. Machine according to claim 11, characterized by the fact that said means for drawing the threads comprise elements driven by cams in order to be brought in active position so as to intercept and draw the thread, and in retracted position so as to abandon the thread, in correspondence of zones—eventually lacking in needles—which space out arches of needles which are intended to form legs respectively bodies.

13. Machine according to claim 12, characterized by the fact that said elements are developed in the form of fingers which are moved to and from the needles working zone.

14. Machine according to claim 10, characterized by the fact that one of the fronts of needles is cylindrical and the other is substantially discoidal with radial needles.

15. Machine according to claim 13, characterized by the fact that one of the fronts of needles is cylindrical and the other is substantially discoidal with radial needles, the fingers being radially moveable to draw the thread to be fed to the needles of the cylindrical front, and being displaceable parallel to the axis of said fronts to draw the feeding thread of the needles of the discoidal front.

16. Machine according to claim 15, characterized by the fact that the two carriers of cams and thread drawing means are driven in synchronism and in such a way that the cams for driving the needles of the two fronts and the drawing means exchange position in an area of correspondence of the fronts for separating and spacing thread between arches of needles of the two fronts which are intended to form tubular fabric, and thus between the leg-like articles and in a crotch zone.

17. Machine according to claim 16, characterized by the fact that in order to selectively drive the needles of the substantially discoidal front, selectors are provided which can be engaged and disengaged by selective movement parallel to the axis of the fronts and which cooperate—when engaged—with oscillation controlling contours to push centrifugally the needles to perform the thread hold; the selection means being located on a cylindrical front, while withdrawal means are provided along the needles trajectory.

18. Machine according to claim 17, characterized by the fact that the substantially discoidal needles front and the carrier of selection means relevant thereto are mounted on a structure which can be axially moved close and away from the needles front.

19. Machine according to claim 18, characterized by the fact of comprising oscillating sinkers with discoidal, arch-shaped appendixes for the oscillation and with guide spacers; said oscillating sinkers being urged by elastic means in one direction and in the opposite direction by drive contours carried by the inversely rotating carriers.

20. Machine according to claim 19, characterized by the fact of comprising end needles which are longer than the other needles belonging to the needle arches which are intended to form a length of tubular fabric, along the legs.

21. A machine for the simultaneous formation of a plurality of tubular knitted articles, capable of simultaneously producing a plurality of tubular articles each being formed by two opposite partial fronts of needles which alternatively form subsequent semi-ranks of stitches with the thread passing from a front to the other according to claim 10, characterized by the fact that end needles of the partial fronts are longer than the others.

22. Machine according to claim 21, characterized by the fact that at the end zones, the sinkers edge which defines the pulling-down plane is higher than the one defined by the other sinkers.

23. Machine according to claim 21, characterized by the fact that the sinkers of the two fronts are fixed and shaped with edges which define the pulling-down plane with convex back profile.

24. Machine according to claim 23, characterized by the fact that at least some of the sinkers present, adjacent to the arched back profile supporting the stitch loops, hook shapings overhanging the edge defining the pulling-down plane.

25. Machine according to claim 23, characterized by the fact that at least some of the sinkers present a profile lacking in hooks.

26. Machine according to claim 25, characterized by the fact that there are provided fixed sinkers having hook shapings alternated with fixed sinkers without hook shapings.

27. Machine according to claim 26, characterized by the fact that to the fixed sinkers having hook shapings of one front, correspond fixed sinkers without hooks in the other front.

28. Machine according to claim 27, characterized by the fact that the sinkers with and without hooks are alternated with a disposition of 1:1.

* * * * *